US007255172B2

(12) United States Patent
Johnson

(10) Patent No.: US 7,255,172 B2
(45) Date of Patent: Aug. 14, 2007

(54) HYDRODYNAMIC, DOWN-HOLE ANCHOR

(75) Inventor: Lynn Dale Johnson, Vernal, UT (US)

(73) Assignee: Tech Tac Company, Inc., Vernal, UT (US)

( * ) Notice: Subject to any disclaimer, the term of this patent is extended or adjusted under 35 U.S.C. 154(b) by 341 days.

(21) Appl. No.: 10/915,783

(22) Filed: Aug. 11, 2004

(65) Prior Publication Data

US 2005/0224233 A1 Oct. 13, 2005

Related U.S. Application Data

(60) Provisional application No. 60/561,699, filed on Apr. 13, 2004.

(51) Int. Cl.
*E21B 29/00* (2006.01)
*E21B 31/16* (2006.01)

(52) U.S. Cl. ..... 166/298; 166/55.6; 166/301; 166/376

(58) Field of Classification Search ..... 166/298, 166/376, 377, 55.6, 55.1, 206, 301, 99
See application file for complete search history.

(56) References Cited

U.S. PATENT DOCUMENTS 2,132,645 A * 10/1938 Reed ..... 166/55.6
2,303,647 A * 12/1942 Le Bus ..... 166/55.6
2,359,717 A * 10/1944 Myers ..... 175/230
2,651,362 A * 9/1953 Storm ..... 166/55.6
2,686,689 A * 8/1954 Pyke ..... 166/301
3,070,170 A * 12/1962 Bus, Sr. et al. ..... 294/86.34
3,091,293 A * 5/1963 Fry ..... 166/123
4,901,793 A 2/1990 Weber
4,921,045 A 5/1990 Richardson
5,038,859 A * 8/1991 Lynde et al. ..... 166/55.6
5,123,489 A * 6/1992 Davis et al. ..... 166/377
5,275,239 A 1/1994 Obrejanu
5,348,090 A 9/1994 Leismer
5,771,969 A 6/1998 Garay
6,152,219 A 11/2000 Vick, Jr. et al.
6,152,233 A 11/2000 Jani et al.
6,550,540 B2 4/2003 Trent
6,702,031 B2 * 3/2004 Doane et al. ..... 166/382

OTHER PUBLICATIONS

Weartherford *Washover Drill Collar Spear*, product paphlet, (2003), p. 1.
Baker Hughes, *Baker Oil Tools: Mills and Shoes*, date unknown, pp. 1-4.

* cited by examiner

*Primary Examiner*—Jennifer H Gay
(74) *Attorney, Agent, or Firm*—Pate Pierce & Baird

(57) ABSTRACT

A method of removably anchoring well tubing in a well bore may include selecting a well having a bore diameter and an anchor positioned therein. The anchor may have a housing defining an anchor diameter and extension members extending therefrom toward the bore diameter. The bore diameter and anchor diameter may be spaced apart a distance defining an annulus therebetween and extending along the well. A tool sized to cut substantially exclusively within the annulus may be selected. The tool may be positioned within the annulus, rotated, and advanced to drive past the housing to remove the extension members between the housing and the bore diameter to free the anchor.

21 Claims, 19 Drawing Sheets

| | Outer Diameter (Inches) | Inner Diameter (Inches) | Cross-Sectional Area (Square Inches) | Resulting Annular Cross-Sectional Area (Square Inches) |
|---|---|---|---|---|
| Well Bore (7 Inch, 23 Pound Casing) | — | 6.37 | 31.85 | — |
| Housing (5.5 Inch) | 5.50 | — | 23.75 | 8.11 |
| Housing (4.5 Inch) | 4.50 | — | 15.90 | 15.96 |

FIG. 26

| | Outer Diameter (Inches) | Inner Diameter (Inches) | Cross-Sectional Area (Square Inches) | Resulting Annular Cross-Sectional Area (Square Inches) |
|---|---|---|---|---|
| Well Bore (5.5 Inch, 17 Pound Casing) | — | 4.89 | 18.77 | — |
| Housing (4.5 Inch) | 4.50 | — | 15.90 | 2.87 |
| Housing (3.75 Inch) | 3.75 | — | 11.04 | 7.73 |

FIG. 27

HYDRODYNAMIC, DOWN-HOLE ANCHOR

RELATED APPLICATIONS

This application claims the priority benefit of co-pending U.S. Provisional Patent Application Ser. No. 60/561,699, filed on Apr. 13, 2004 for SLIP WELL ANCHOR.

BACKGROUND

1. The Field of the Invention

This invention relates to wells and, more particularly, to novel systems and methods for anchoring tubing within a well bore.

2. The Background Art

The presence of methane ($CH_4$, a principal ingredient of natural gas) in underground coal seams has long been known. In the past, coal bed methane was vented to provide a non-explosive, non-suffocating environment in which coal miners could work. However, in recent times, methane has become a popular fuel for use in electric generators, furnaces, city buses, and the like. Methane's popularity may largely be attributed to its relatively low cost and clean combustion characteristics.

By drilling down to a coal seam aquifer and pumping out water, the pressure holding the methane within the coal seam may be relieved somewhat as it propels methane and water mixed therewith up the well bore (typically a cased bore). The methane may then be gathered, compressed, and shipped to customers. Well drilling and production techniques permit the collection of methane from coal seams at virtually all depths at which coal is available. Thus, coal bed methane may be collected from coal seams that are far too deep to be mined themselves.

In the past water and oil well technologies have been used to collect methane from coal seam aquifers. However, some of the equipment now in use is not optimal for the unique requirements of coal bed methane collection. For example, down-hole, tubing anchors developed for the oil industry do not have to deal with many of the annular flow demands found in coal bed methane extraction. When applied to a coal bed methane wells, typical anchors may limit gas production. What is needed is a down-hole tubing anchor specifically designed to handle annular flows, such as those found in coal bed methane wells.

BRIEF SUMMARY OF THE INVENTION

In certain situations, it may be desirable to employ an anchor to secure tubing within a well. In general, an anchor may be connected in series with various sections of tubing. After being lowered within a well bore to a selected depth, the tubing may be rotated (activated) causing an anchor to extend one or more slips (engagement shoes) to engage the well bore and secure the anchor and the attached tubing. An anchor may be used within a well to resist rotation of the tubing, maintain it centered in the bore, or to facilitate application of a force (e.g. a tension force) to the tubing.

An anchor may be applied to wells having flows in an annulus formed between the exterior of the tubing and the interior of the well bore. For example, in certain embodiments, an anchor may be applied to a coal bed methane well. An anchor in accordance with the present invention may provide the structure necessary to accomplish the anchoring function without overly blocking or interfering with flow in this annulus. For example, in selected embodiments, anchors in accordance with the present invention may be generated in a comparatively smaller diameter to leave a greater space between the anchor and the well bore. Oversized slips may be used to accomplish the greater throw (radial extension) necessary to reach and engage (grip) the well bore. If desired, oversized slips may be chamfered or otherwise shaped to facilitate their admittance within the anchor housing during assembly. This increase in space or clearance between the anchor and the well bore may reduce drag area and drag shape factors to improve gas production from coal bed methane wells to levels unobtainable with conventional anchors.

In selected embodiment, fairings or flow directors may be applied to an anchor. The fairings may make the anchor more hydrodynamic and less disruptive to the flow of water, gas, and debris past the anchor. In certain embodiments, fairings may be placed on only one end of a well anchor. The end selected for the fairing may be the leading or trailing end with respect to flow in the annulus between the well bore and the tubing being. In an alternative embodiment, a fairing may be applied to both ends of the well anchor. Gas and water may flow up past an anchor or down past an anchor to exit the well. They may travel up the bore, to a pump, or the like. With a fairing on both ends of anchor, the flow characteristics of the gas and water can be the same no matter which direction the gas and water are traveling (i.e. up or down within the well bore). This may be useful in situations where it is difficult to determine before installation which direction the flow in the annulus with be traveling at any given depth.

Increased spacing between an anchor housing and a well casing may provide several advantages. As mentioned, the spacing may permit fluids to pass by more easily. Also, the increased spacing and resulting flow appear to limit resultant corrosion. Moreover, the spacing may facilitate removal of an anchor that becomes jammed, seized, or otherwise inoperatively locked in a well bore. The smaller diameter of an anchor housing may allow a tool (e.g. a coring drill bit) to free a jammed anchor by simply cutting through the slips extend radially outward therefrom. Thus, the tool need not cut through the entire length of an anchor housing as may be the case with anchors of a larger, conventional diameter. By limiting the amount of material that must be drilled out, removed, or cut, significant time savings may be achieved.

BRIEF DESCRIPTION OF THE DRAWINGS

The foregoing and other objects and features of the present invention will become more fully apparent from the following description and appended claims, taken in conjunction with the accompanying drawings. Understanding that these drawings depict only typical embodiments of the invention and are, therefore, not to be considered limiting of its scope, the invention will be described with additional specificity and detail through use of the accompanying drawings in which:

FIG. 26 is a table illustrating the various annular, cross-sectional areas produced using seven inch, twenty-three pound well casing in conjunction with five and a half inch and four and half inch anchor housing;

FIG. 27 is a table illustrating the various annular, cross-sectional areas produced using five and a half inch, seventeen pound well casing in conjunction with four and a half inch and three and three quarter inch anchor housing;

DETAILED DESCRIPTION OF THE PREFERRED EMBODIMENTS

It will be readily understood that the components of the present invention, as generally described and illustrated in the Figures herein, could be arranged and designed in a wide variety of different configurations. Thus, the following more detailed description of the embodiments of the system and method of the present invention, as represented in FIGS. 1 through 29, is not intended to limit the scope of the invention, as claimed, but is merely representative of various embodiments of the invention. The illustrated embodiments of the invention will be best understood by reference to the drawings, wherein like parts are designated by like numerals throughout.

Figure 1:
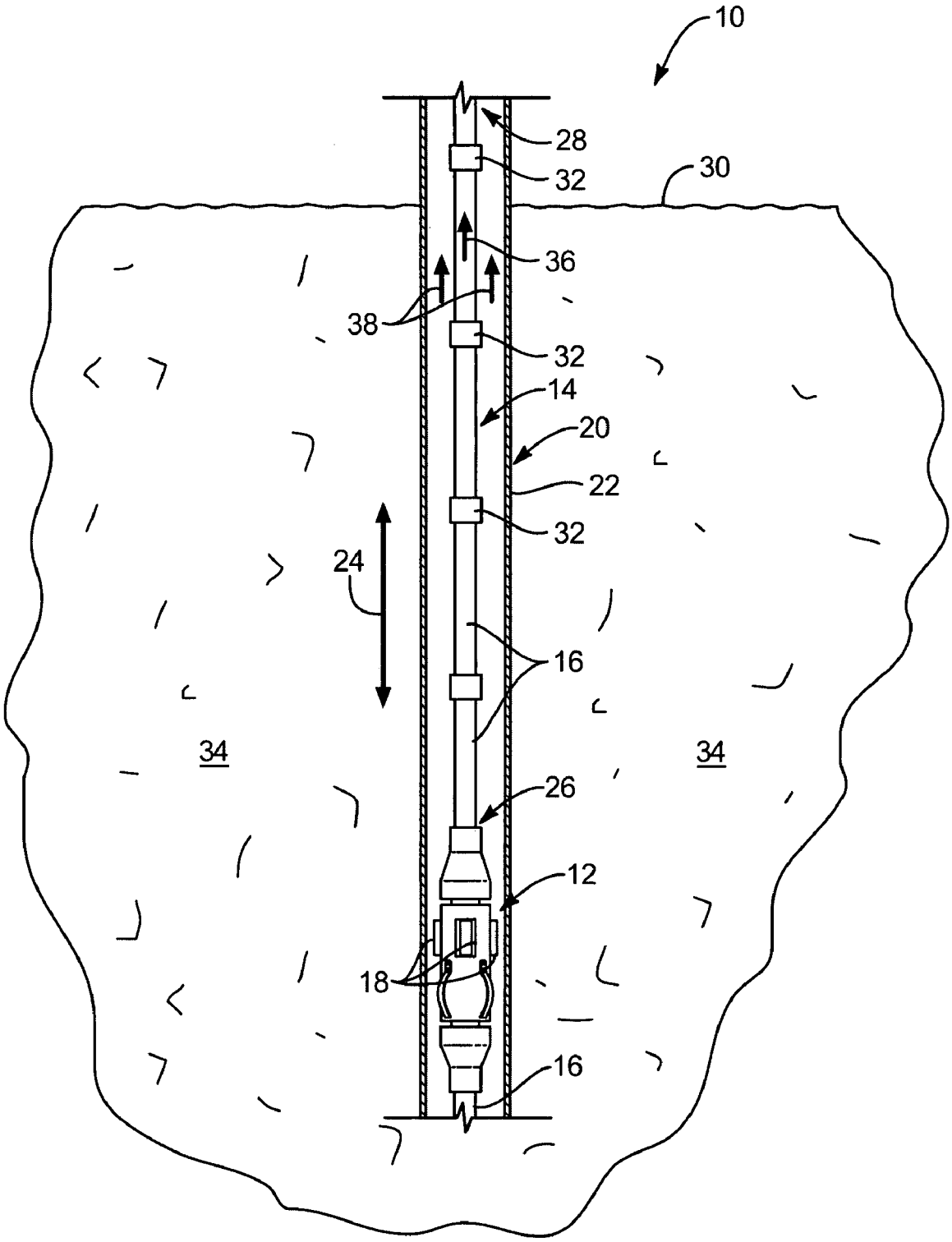
FIG. 1 is a side, elevation, partial cross-sectional view of a well have a well bore and anchor in accordance with the present invention.
Figure 2:
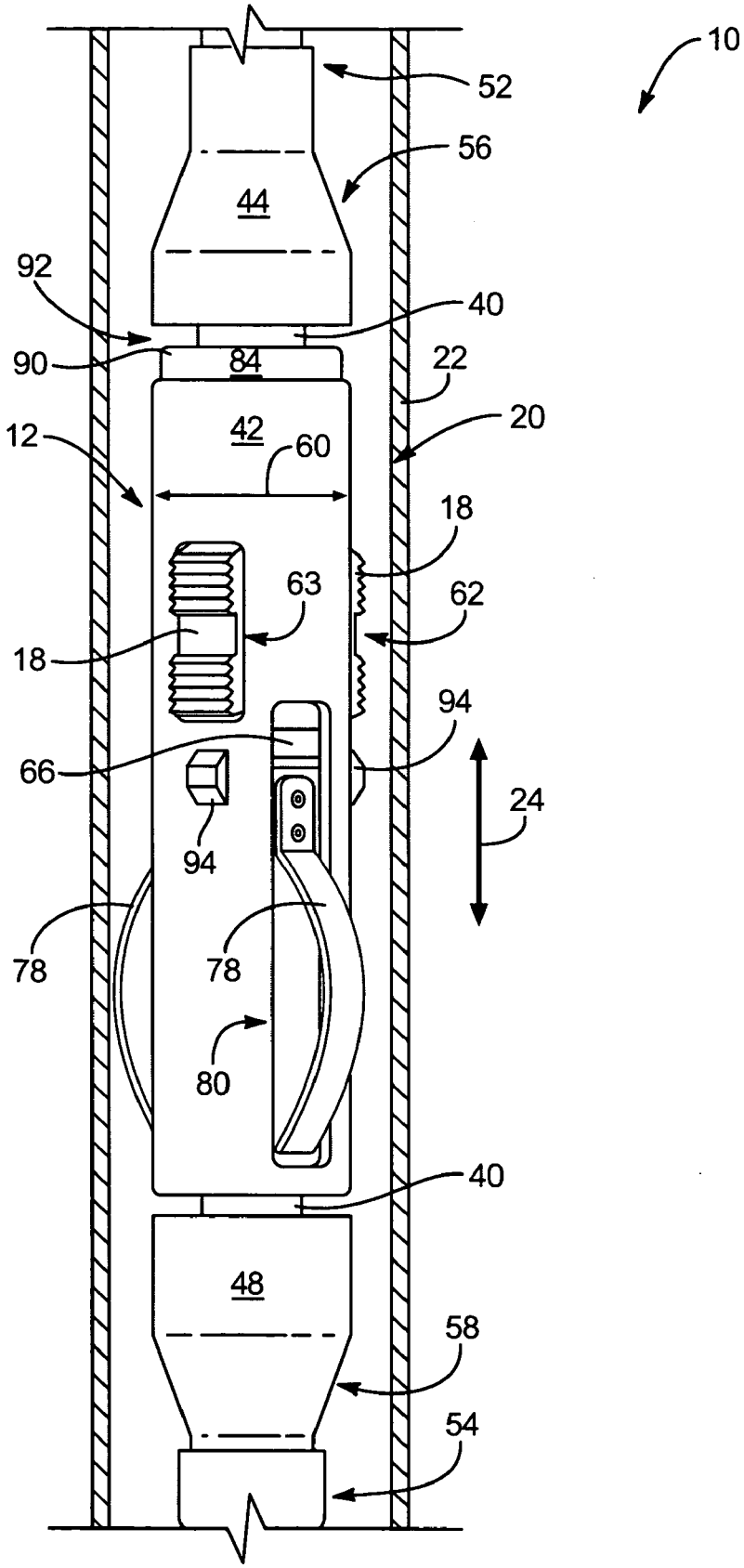
FIG. 2 is a side, elevation, partial cross-sectional view of a well bore and anchor in accordance with the present invention.
Figure 3:
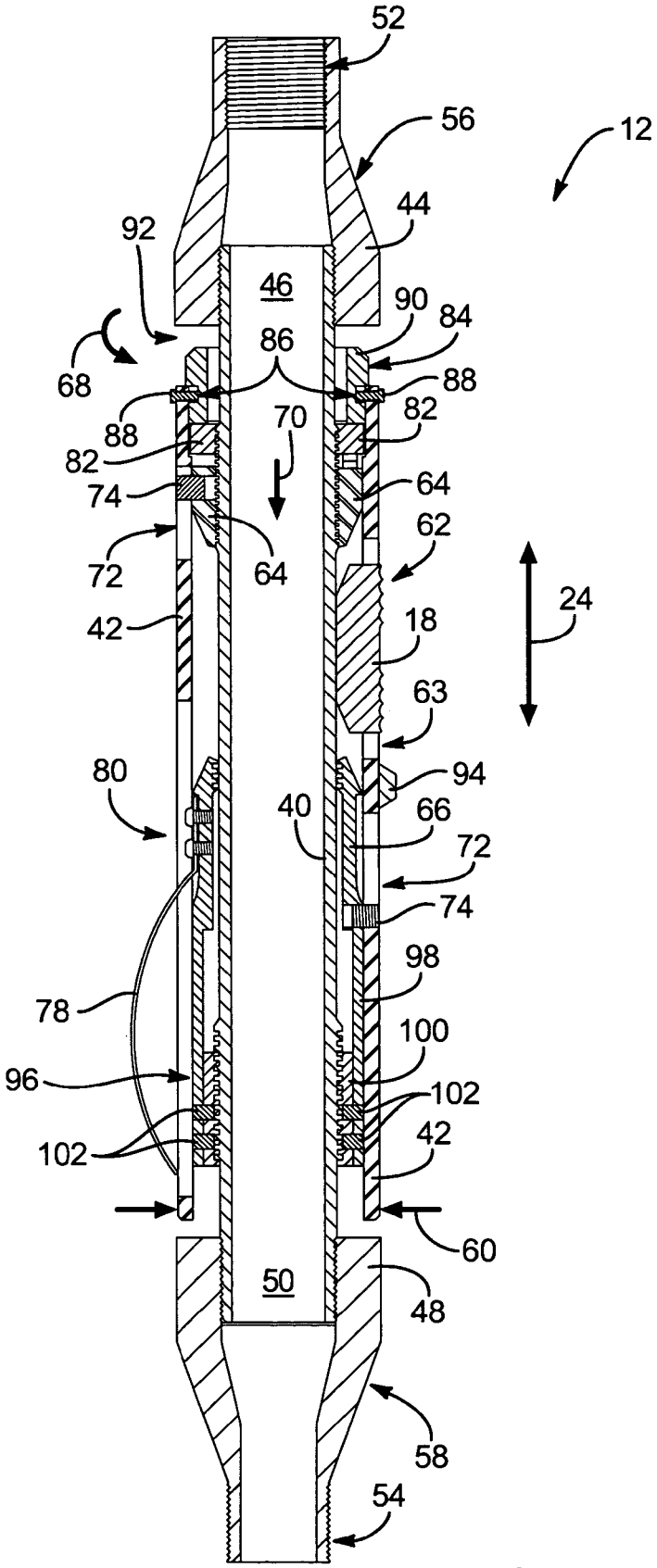
FIG. 3 is a side, elevation, cross-sectional view of the anchor of FIG. 2.
Figure 4:
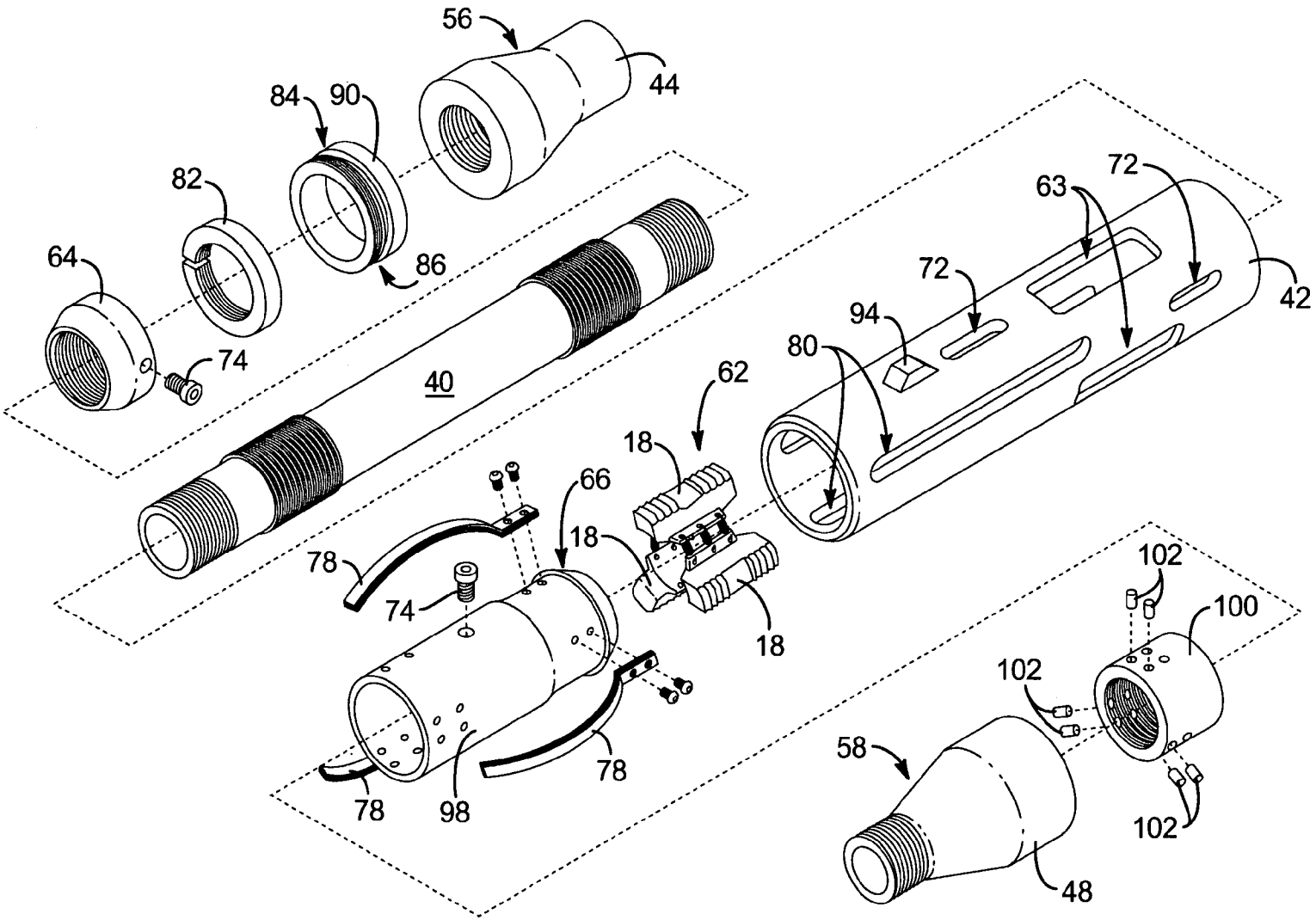
FIG. 4 is a perspective, exploded view of the anchor of FIG. 2.

Referring to FIG. 1, in various types of wells 10, it may be desirable to employ an anchor 12 to secure tubing 14 within the well 10. In general, an anchor 12 may be connected in series with various sections 16 of tubing 14. After being lowered within a well bore 20 to a selected depth, the tubing 14 may rotated, causing an anchor 12 to extend one or more slips 18 radially outward until they engage the well bore 20 and secure the anchor 12 and attached tubing 14. In selected embodiments, the well bore 20 may be formed by a well casing 22.

An anchor 12 may secure tubing 14 in more than one axial direction 24. For example, in certain embodiments, it may be desirable to load tubing 14 in tension. In such an embodiment, an anchor 12 may secure one end 26 of the tubing while the other end 28 is pulled upward from the surface 30. Tension may tend to straighten the tubing 14. In certain embodiments, straighter tubing 14 may reduce wear on sucker rods or the like passing therethrough.

In other embodiments, an anchor 12 may be used as a catcher. In such an embodiment, the anchor 12 may resist the tendency of the tubing 14 to fall to the bottom of the well 10 when some connection 32, section 16, or the like fails. In certain embodiments, an anchor 12 in accordance with the present invention may be arranged to support tensile loads as well as act as a catcher.

An anchor 12 in accordance with the present invention may be used within a coal bed methane well 10. In describing the present invention, a coal bed methane well 10 will be used as an example of how the present invention, to be described in detail hereinbelow, may be applied. Those of skill in the art will recognize that the present invention may be applied with minimal adaptations to conventional oil well pumping situations with similarly beneficial results.

A coal bed methane well 10 provides access to one or more coal seams buried under a significant amount of overburden 34. The depth of overburden 34 covering a coal seam may be anywhere from a few tens to thousands of feet. Typically depths of overburden 34 range from 400 to 3000 feet.

Coal bed methane wells 10 may comprise a bore 20 (hole 20) from the earth's surface 30 to the coal seam. Once the bore 20 is drilled, a well casing 22 may be inserted and sealed to provide a closed, stable flow path from an inlet at the coal seam to an outlet at the surface 30. In certain applications, a well casing 22, rather than stopping at or near the top of a coal seam, may extend into or through a coal seam. The well casing 22 may then be perforated to provide fluid communication from the coal seam to the interior of the well casing 22.

Coal seams are typically aquifers. Often, the water within a coal seam aquifer acts as a stopper, resisting the escape of gas. Thus, to permit gas entrained within the coal seam to escape up the well 10, the water pressure within the well 10 must be relieved. This process is known as de-watering a well 10. De-watering is accomplished by pumping water from the well 10. Depending on the flow of water within a coal seam aquifer, de-watering may take as many as 18-24 months. Actually, water may move the gas through the coal formation, and thus be a required motive means for gas extraction. By whatever mode, extracting water extracts gas.

Pumps of various types may be used to de-water a coal bed methane well 10. For example, suitable pumps may include, without limitation, sucker rod, submersible, centrifugal, and progressive cavity pumps. In certain embodiments, the selection of a particular kind of pump may effect the placement of an anchor 12. In general, however, anchors 12 in accordance with the present invention may be placed above or below a pump or pump inlet. Similarly, anchors 12 in accordance with the present invention may be placed above or below the coal seam aquifer.

As water is pumped up 36 the tubing 14 of a coal bed methane well 10, methane may be liberated to flow up 38 an annulus 40 formed between the tubing 14 and the well bore 20 or well casing 22. In certain embodiments, significant amounts of water may also pass through the annulus 40. Depending on the depth of the well 10 and the amount of gas and water produced, water within the annulus 40 may surface, froth up 38 and down (opposite), or remain near the bottom of the well 10. Accordingly, an anchor 12 in accordance with the present invention may be positioned in a location where gas, water, or both gas and water pass by. In certain embodiments, the flow passing by an anchor 12 may be predictable and unidirectional. In other embodiments, the flow may be random and bi-directional.

Referring to FIGS. 2-5, an anchor 12 in accordance with the present invention may include a mandrel 40 and a housing 42. A mandrel 40 may provide a continuous path joining the tubing 14 connected on either end of the anchor 12. In selected embodiments, a first coupler 44 may connect a first end 46 of the mandrel 40 to a section 16 of tubing 14, while a second coupler 48 may connect a second end 50 of the mandrel to another section 16 of tubing 14.

In selected embodiments, first and second couplers 44, 48 in accordance with the present invention may be arranged to support connections of various genders. For example, it is typical that a section 16 of tubing 14 have a female threaded end and a male threaded end. Similarly, first and second couplers 44, 48 may form a female threaded end 52 and a male threaded end 54 on an anchor 12. Accordingly, an anchor 12 maybe secured in a string of tubing 14 as if it were any other section 16.

In certain embodiments, first and second couplers 44, 48 may include fairings 56, 58. Fairings 56, 58 may be arranged to produce a smooth profile or outline for the anchor 12 to reduce drag on the gas, water, or both gas and water passing by the anchor 12. In one embodiment, the fairings 56, 58 may provide a substantially gradual transition from approximately the diameter 60 of the housing 42 to approximately the diameter of the mandrel 40.

Anchors 12 in accordance with the present invention may include a slip assembly 62. A slip assembly 62 may provide an interface between the mandrel 40 and the housing 42 such that relative rotation therebetween may extend one or more slips 18 through one or more apertures 63 in the housing 42 to engage the well bore 20 (e.g. well casing 22).

For example, in certain embodiments, a slip assembly 62 may include first and second cones 64, 66. The first and second cones 64, 66 may both threadingly engage the mandrel 40. The threads of the first cone 64 may be arranged so that rotation thereof in a first circumferential direction 68 will cause it to travel in a first longitudinal direction 70 along the mandrel 40. The threads of the second cone 66 may be arranged so that rotation thereof in the first circumferential direction 68 will cause it to travel in a direction opposite the first longitudinal direction 70 along the mandrel 40.

Accordingly, rotation of the mandrel 40 in a first circumferential direction 68 while the first and second cones 64, 66 are stopped from rotating, will cause the first and second cones 64, 66 to draw nearer one another. Conversely, rotation of the mandrel 40 in a direction opposite the first circumferential direction 68 while the first and second cones 64, 66 are stopped from rotating, will cause the first and second cones 64, 66 to distance themselves from one another.

One or more slips 18 may be placed between the first and second cones 64, 66. When the cones 64, 66 draw together, the one or more slips 18 may be wedged away from the mandrel 40 toward engagement with the well bore 20. When the cones 64, 66 separate, the one or more slips 18 may retract toward the mandrel 40 and disengage from the well bore 20.

In selected embodiments, various slots 72 may be formed in the housing 42. Fasteners 74 may extend through the slot 72 to engage the first or second cones 64, 66. The fasteners 74 may be positioned so that at least a portion thereof extends into the slot 72. A cone 64,66 so arranged may then only move with respect to the housing 42 according to how the fastener 74 may travel within the slot 72. For example, the width of a slot 72 may control the extent of rotation of a cone 64, 66 within the housing 42. Similarly, the length of a slot 72 may control the extent of translation of a cone 64, 66 within the housing 42.

In one embodiment, the slots 72 and fasteners 74 may be sized to substantially prohibit rotation of the cones 64, 66 within the housing 42, while providing translation of the cones 64, 66 within the housing 42 for a selected distance 76. This distance 76 may be selected to allow the cones 64, 66 the translation necessary to fully extend and fully retract the one or more slips 18. The fasteners 74 may be removable to facilitate assembly and disassembly of the anchor 12.

In certain embodiments, an anchor 12 in accordance with the present invention may include one or more drag springs 78. A drag spring 78 may serve several purposes. For example, a drag spring 78 may maintain an anchor 12, as well as neighboring tubing 14, generally centered as it is lowered into a well bore 20 or well casing 22. A drag spring 78 may also provide some comparatively modest resistance to relative rotation between whatever structure supports the drag spring 78 and the well bore 20.

In one embodiment, a drag spring 78 may be secured to a cone 64, 66. In such an embodiment, one or more apertures 80 may be formed in the housing 42 to permit the one or more drag springs 78 to extend therethrough. For example, in the illustrated embodiment, one or more drag springs 78 may be secured to the second cone 66. Accordingly, the one or more drag springs 78 may resist rotation of the second cone 66 with respect to the well bore 20. This resistance to relative rotation with respect to the well bore 20 may be passed to the housing 42 through a slot 72 and fastener 74 arrangement. Similarly, the resistance to relative rotation may be passed from the housing 42 to the first cone 64 through another slot and fastener 74 arrangement.

As stated hereinabove, rotation of the mandrel 40 in a first circumferential direction 68 while the first and second cones 64, 66 are stopped from rotating, will cause the first and second cones 64, 66 to draw nearer one another. Drag springs 78 in accordance with the present invention may provide the force necessary to stop, or at least limit, the rotation of the cones 64, 66 with a rotating mandrel 40. Accordingly, the cones 64, 66 may translate to extend or retract the one or more slips 18.

Drag springs 78 in accordance with the present invention may have any suitable shape or arrangement to provide a desired centering action or resistance to rotation. In general, drag springs 78 may be shaped to extend from the anchor 12 to reach the well bore 20. In selected embodiments, drag springs 78 may arc to facilitate travel of the anchor 12 both up and down the well bore 20.

The centering action or resistance to rotation provided by a drag spring 78 may be controlled in at least one of two ways. The thickness, width, or both the thickness and width of the drag spring 78 may be increased or decreased to correspondingly increase or decrease the effective spring constant. Alternatively, the number of drag springs 78 used may be increased or decreased to correspondingly increase or decrease the effective springs constant. If desired, drag springs 78 may be stacked to create a composite spring having an effective spring constant equal to a summation of the individual spring constants.

Anchors 12 in accordance with the present invention may include various features to improve performance. For example, in selected embodiments, a locking ring 82 and end cap 84 may form a stop to limit the travel of the first cone 64. The locking ring 32 and end cap 84 may also act to limit admittance of debris (e.g. sand, rock) into the anchor 12. An end cap 84 may have any suitable shape. In one embodiment, an end cap 84 may have a channel 86 formed therein to receive one or more set screws 88. The set screws 88 may aid in securing the end cap 84 to the housing 42.

An end cap 84 may also have an extension 90. In certain embodiments, an extension 90 may be shaped as a fairing 56 to provide a substantially gradual transition from approximately the diameter 60 of the housing 42 to approximately the diameter of the mandrel 40. In other embodiments, the extension 90 may simply provide a shield against debris. In one embodiment, the length of an extension 90 may be limited to reduce the gap 92 between the housing 42 and a fairing 56 formed as part of a coupler 44.

Certain anchors 12 in accordance with the present invention may include a slip protector 94. As an anchor 12 is lowered into a well 10, slips 18 may wear against the well bore 20. As a result, the slips 18 may no longer have the sharp edges necessary to bite into and otherwise engage the well bore 20 once the anchor 12 reaches the desired depth. A slip protector 94 may extend from the housing 42 a distance selected to shield a slip 18 from unduly abrasive contact with the well bore 20 when the anchor 12 is in transit along the bore. In one embodiment, a slip protector 94 comprises a ramped piece of hardened metal welded, bolted, or otherwise secured to the housing 42 at a selected location near a slip 18.

In certain embodiments, a slip protector 94 in accordance with the present invention may be place in "front" of every slip 18. In other embodiments, slip protectors 94 may be positioned in front of and behind a slip 18 to protect the slip 18 as the anchor 12 descends or ascends. Alternatively, a front or rear positioned slip protector 94 may have a height sufficient to protect a slip 18 regardless of the anchor's 12 direction of travel within the well bore 20.

An anchor 12 in accordance with the present invention may include a breakaway assembly 96. For example, in certain embodiments, a second cone 66 may be formed as two separable pieces, a body 98 and a threaded sleeve 100. A number of shear pins 102 may secure the threaded sleeve 100 to the body 98 in the axial direction 24. The shear pins 102 may be sized or the number of shear pins 102 selected such that during normal operation, the body 98 and threaded sleeve 100 move along the mandrel 40 as a single unit.

In situations where an anchor 12 locks and the cones 64, 66 are unable to move and allow the one or more slips 18 to retract, a mandrel 40 may be pulled toward the surface 30 until sufficient force is generated to shear the shear pins 102. Upon failure of the shear pins 102, the body 98 of the second cone 66 may freely travel in an axial direction 24 along the mandrel 40. Accordingly, the second cone 66 may no longer be able to supply the forces necessary to maintain the one or more slips 18 in extended positions, and anchor 12 may be freed.

Figure 5:
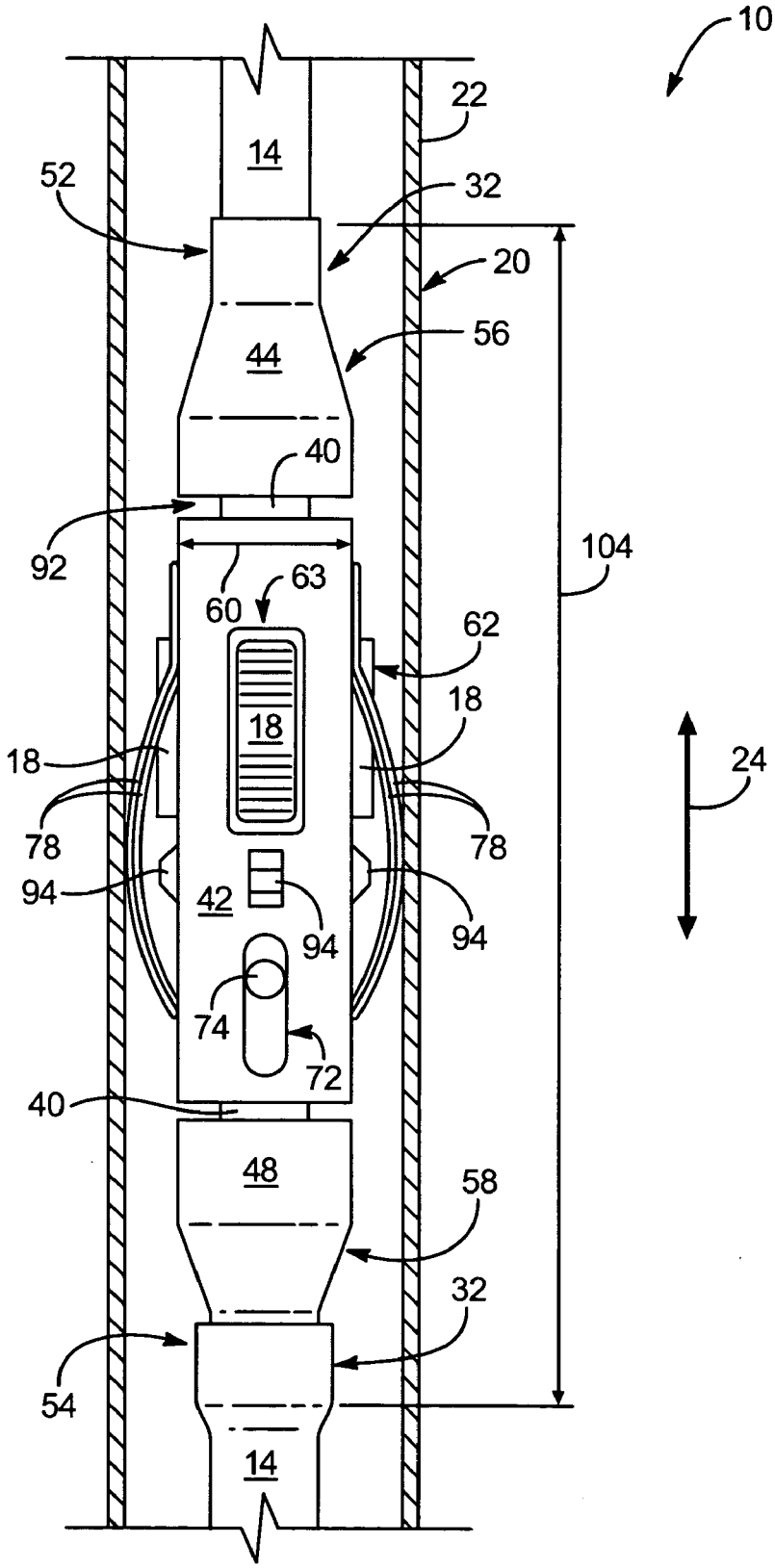
FIG. 5 is a side, elevation, partial cross-sectional view of a well bore and an alternative embodiment of an anchor in accordance with the present invention.
Figure 6:
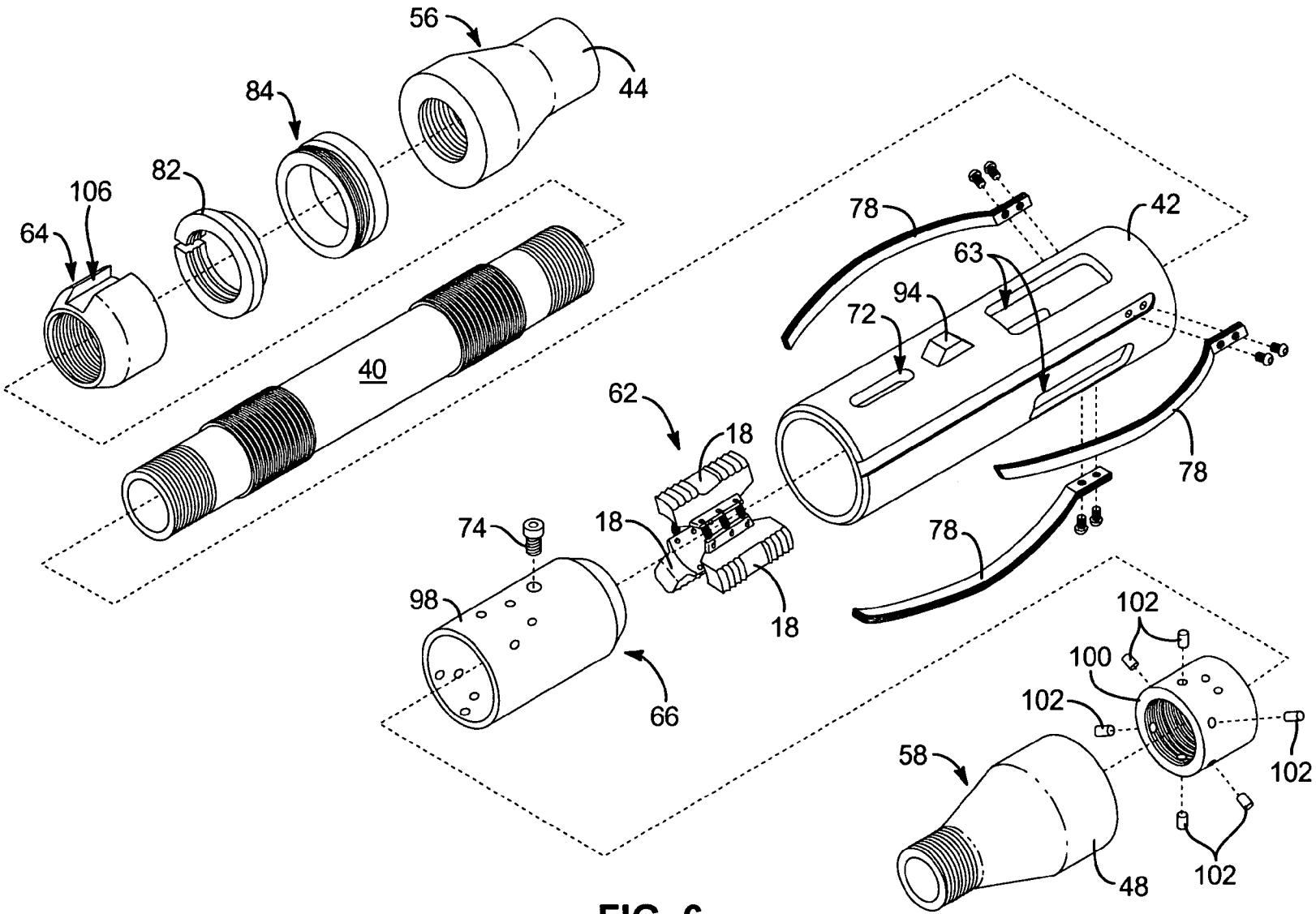
FIG. 6 is a perspective, exploded view of the anchor of FIG. 5.

Referring to FIGS. 5 and 6, in selected embodiments, one or more drag springs 78 may secure directly to the housing 42. In such an arrangement, the one or more drag springs 78 may be positioned on the housing 42 without regard to the locations of cones 64, 66 therewithin. In certain embodiments, securing the drag springs 78 to the housing 42 may facilitate creation of an anchor 12 having a shorter overall length 104.

Various mechanisms may be used to limit the movement of a cone 64, 66 with respect to the housing 42. In certain embodiments, a tongue and groove type mechanism may be used. For example, a groove 106 may be formed in a cone 64, a corresponding tongue may be positioned within the housing 42. The groove 106 and tongue may be shaped and sized to substantially prohibit rotation of the cone 64 within the housing 42, while providing translation of the cone 64 in the axial direction 24 within the housing 42. A tongue-and-groove type mechanism may also be applied to the second cone 66. In an alternative embodiment, the grooves may be formed in the housing 42 while the tongues are formed in one or more of the cones 64, 66.

Figure 7:
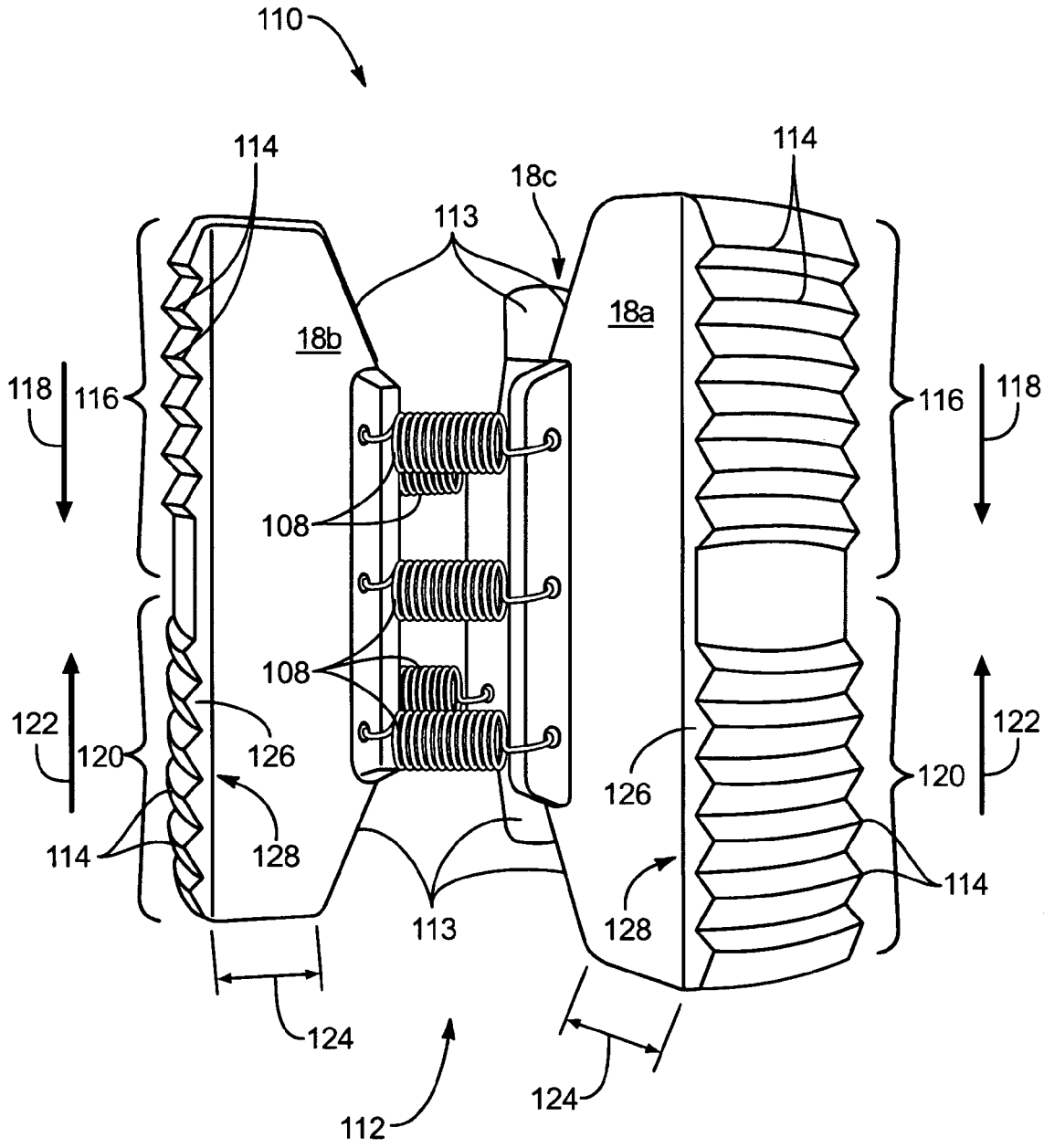
FIG. 7 is a perspective view of an arrangement of slips connected by springs in accordance with the present invention.
Figure 8:
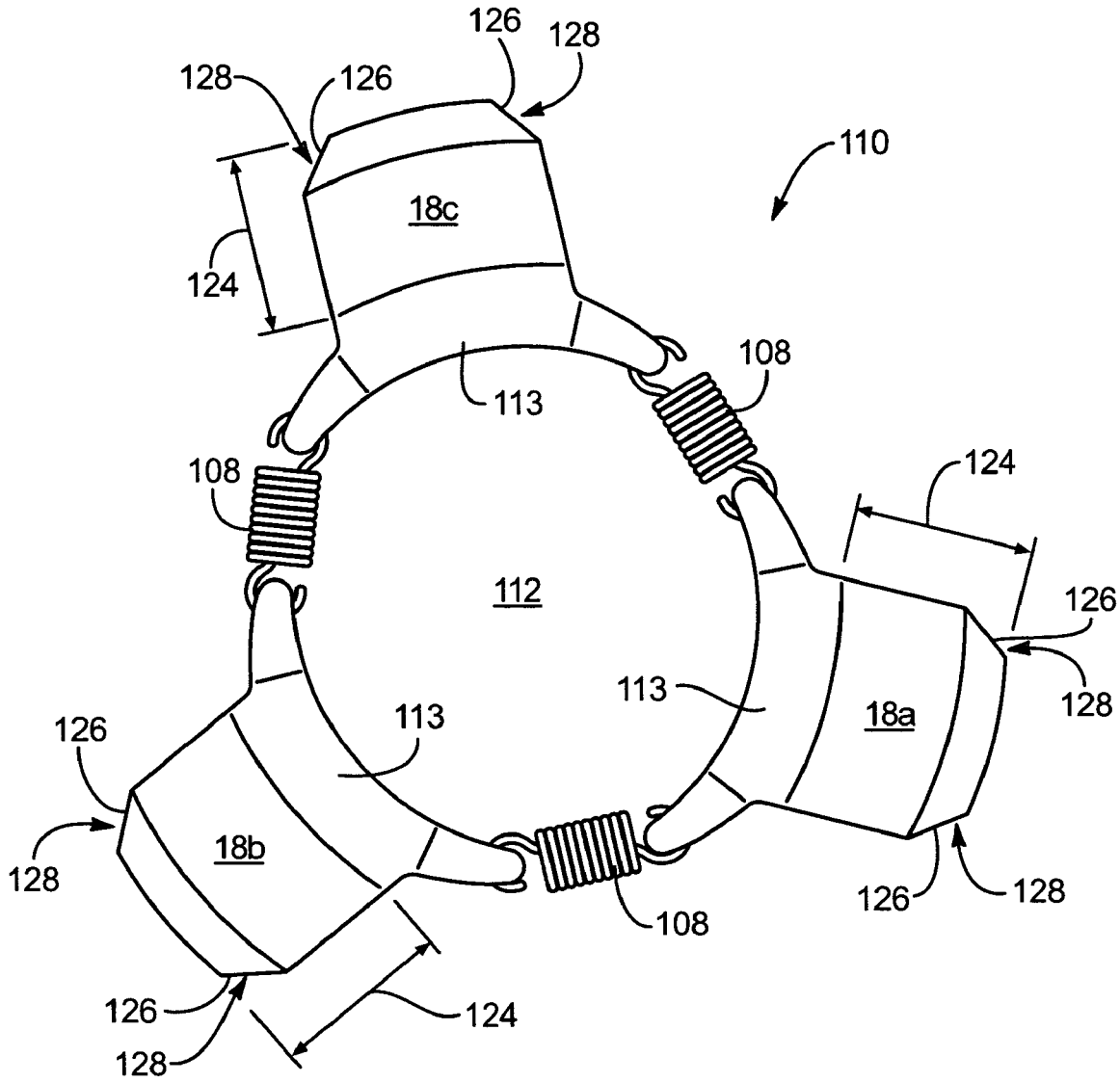
FIG. 8 is a top, plan view of the arrangement of slips of FIG. 7.

Referring to FIGS. 7 and 8, multiple slips 18 may be connected together to provide a mechanism for retraction. For example, in selected embodiment, three slips 18 may be interconnected using biasing members 108 (e.g. springs). A first slip 18*a* may be connected to a second slip 18*a* by one or more biasing members 108. The second slip 18*b* may be connected to a third slip 18*c* by one or more biasing members 108. The third slip 18*c*, in turn, may be connected to the first slip 18*a* by one or more biasing members 108.

In such an arrangement, the slips 18 and biasing members 108 may form a ring 110 around a central opening 112. The central opening 112 may be sized to permit a mandrel 40 to pass therethrough. If desired, an mandrel 40 may be passed through the central opening 112 only upon a stretching or deflection of the biasing members 108. This preloading of the biasing members 108 may maintain the slips 18 in abutment with the mandrel 40 until they are acted upon by the cones 64, 66.

In selected embodiments, slips 18 in accordance with the present invention may be ramped. For example, a ramp 113 may be formed on the top 116 and bottom 118 of each slip 18 on the interior side, with respect to the central opening 112, of the slips 18. Accordingly, as first and second cones 64, 66 are advanced toward the slips 18, the ramps 113 may interact with the cones 64, 66 to urge the slips 18 radially away from the mandrel 40.

In such embodiments, advancing cones 64, 66 may affirmatively force the slips 18 to extend. Retreating cones 64, 66, on the other hand, may not necessarily force the slips 18 to retract. Biasing members 108 may be included to assist in the retraction of the slips 18. As a ring 110 of slips 18 is urged radially away from a mandrel 40, the circumference of the ring 110 must increase. The biasing members 108 may be arranged to stretch or deflect to accommodate this increase in circumference. Conversely, as the cones 64, 66 retreat, the biasing members 108 may urge or cause the circumference of the ring 110 to correspondingly decrease.

In selected embodiments, slips 18 in accordance with the present invention may have various teeth 114 formed to extend from the exterior side, with respect to the central opening 112, of the slips 18. In certain embodiments, the teeth 114 may be formed of the same material as the rest of the slip 18. Alternatively, the teeth 114 may be formed an inserts. For example, in certain applications, carbide (e.g. carbide steel, carbide allow, etc.) dowels may be embedded within a slip 18 to extend at an angle therefrom. The carbide dowels may permit the slip 18 to bite into well bores 20 formed of comparatively harder materials than would conventional steel.

Teeth 114 may extend from a slip 18 at a variety of angles. For example, the teeth 114 on a first half 116 of a slip 18 may be angled to engage a well bore 20 to resist motion of the slip 18 with respect to the well bore 20 in a first direction 118. The teeth 114 on a second half 120 of a slip 18 may be angled to engage a well bore 20 to resist motion of the slip 18 with respect to the well bore 20 in a second direction 122. Accordingly, the arrangement of the teeth 114 on a slip 18 may provide an anchor 12 with the gripping it needs to act as anchor and catcher.

Slips 18 in accordance with the present invention may have a height 124. Various factors may be considered when selecting the height 124 of the one or more slips 18. For example, the inner diameter of the bore 20, the diameter (inner and outer) of the housing 42, the outer diameter of the mandrel 40, as well as the extension throw generated by the cones 64, 66 acting in conjunction with the ramps 113 may be considered. In selected methods of assembly, a slip 18, or arrangement of slips 18 must be able to fit within the inner diameter of the housing 42. When assembled, it may be undesirable for a slip 18 to extend from the outer diameter of a mandrel 40 past the outer diameter of the housing 42 more than a selected amount. In operation, the height 124 of slip 18 may be selected such that the height 124 and extension throw combine to allow the slip 18 to reach and engage the well bore 20.

In certain embodiments, slips 18 may be modified so that a height 124 that would otherwise be prohibitive, may be used. For example, in selected embodiments, slips 18 may have chamfers 126 formed on the outer edges 128 to facilitate admittance of the slip 18 or an arrangement of slips 18 within the housing 42.

Figure 9:
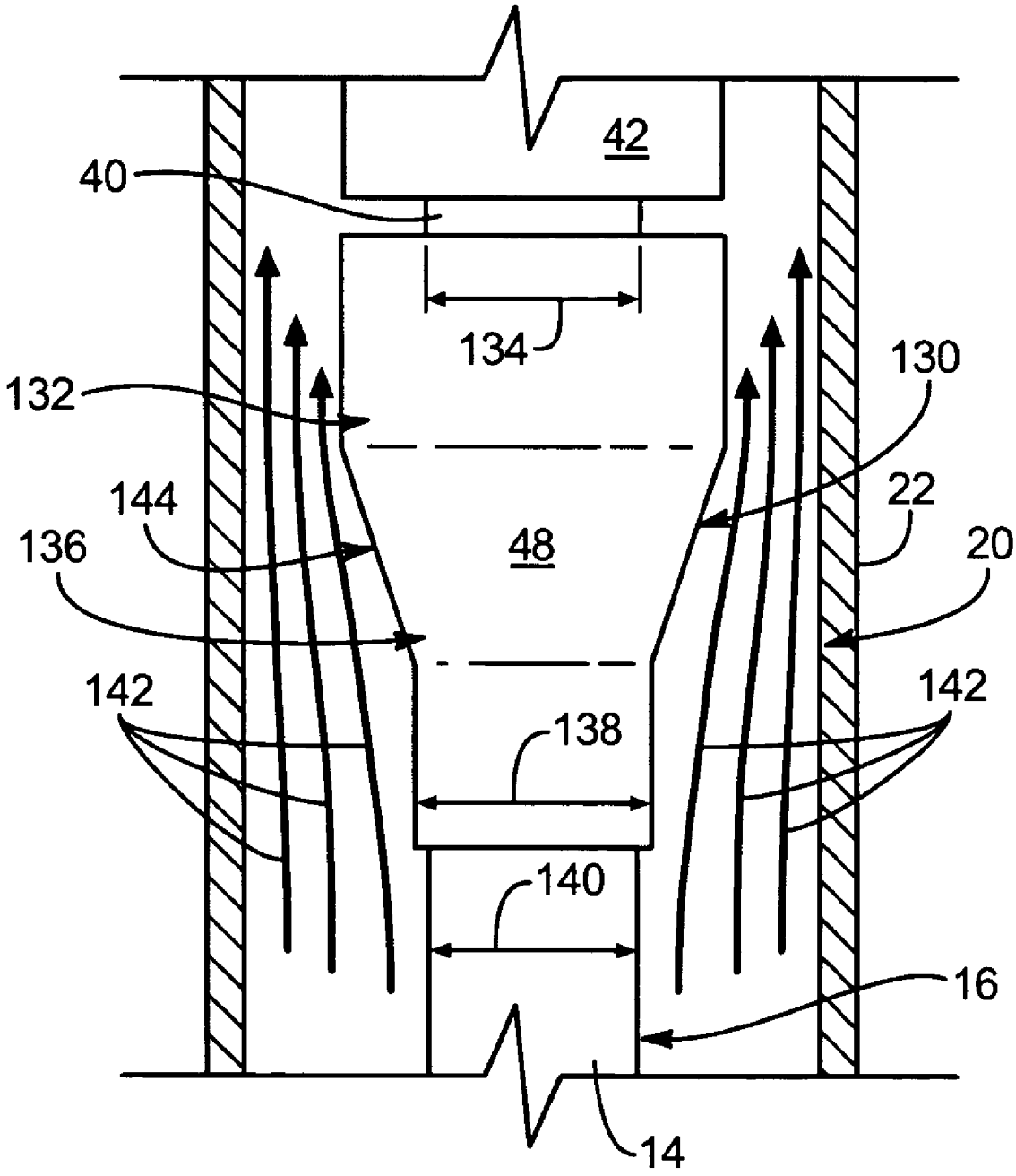
FIG. 9 is a side, elevation, partial cross-sectional view of a well bore and anchor having a leading fairing in accordance with the present invention.
Figure 10:
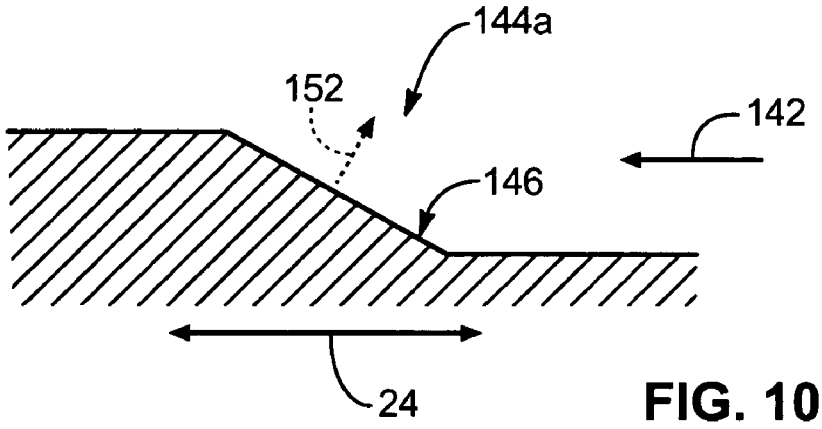
FIG. 10 is a side, elevation, partial cross-sectional view of a profile for a fairing in accordance with the present invention.
Figure 11:
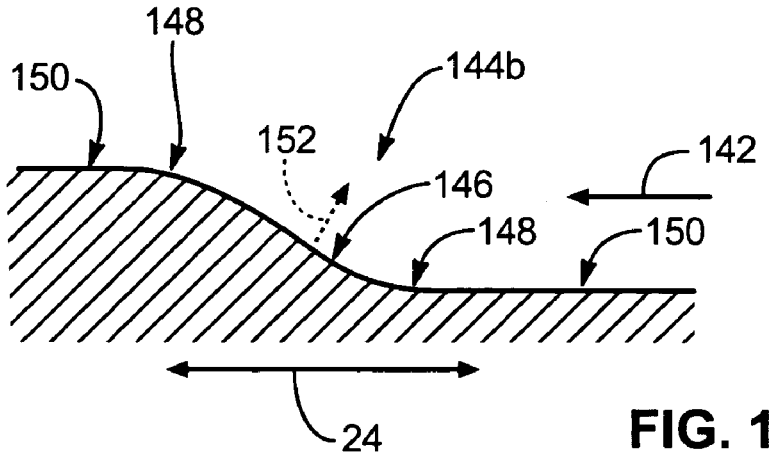
FIG. 11 is a side, elevation, partial cross-sectional view of an alternative profile for a fairing in accordance with the present invention.
Figure 12:
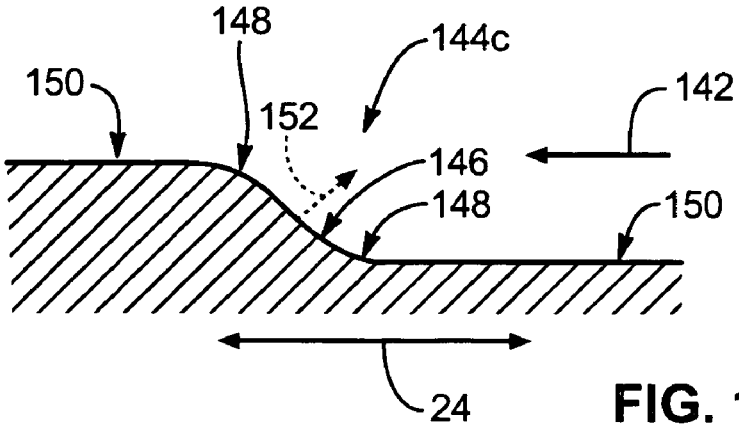
FIG. 12 is a side, elevation, partial cross-sectional view of an alternative profile for a fairing in accordance with the present invention.
Figure 13:
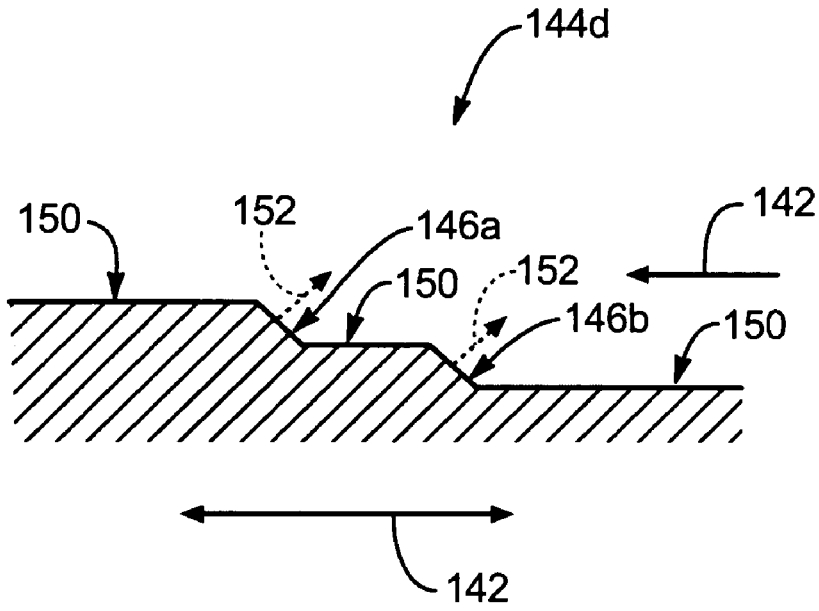
FIG. 13 is a side, elevation, partial cross-sectional view of an alternative profile for a fairing in accordance with the present invention.
Figure 14:
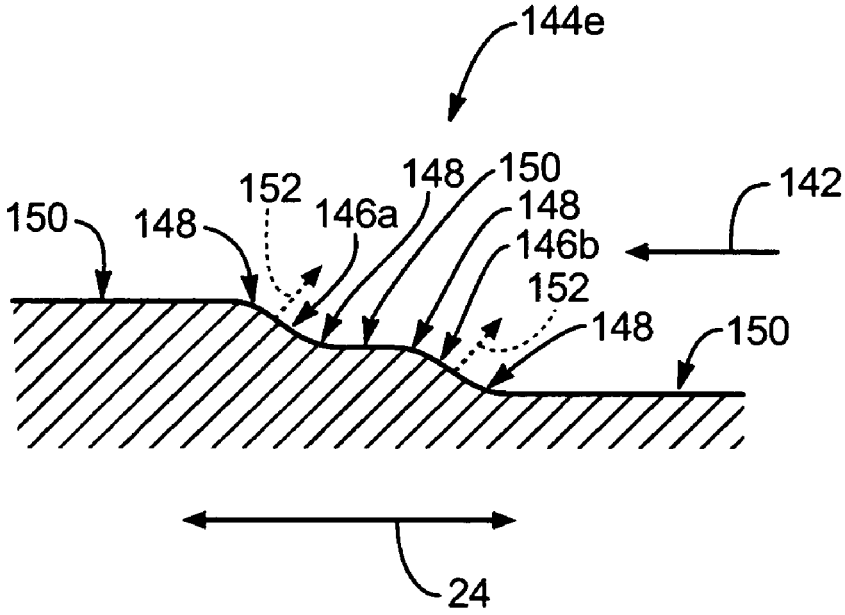
FIG. 14 is a side, elevation, partial cross-sectional view of an alternative profile for a fairing in accordance with the present invention.

Referring to FIG. 9, selected embodiments in accordance with the present invention may include a leading fairing 130. A leading fairing 130 may be defined as a fairing 56, 58 located at or near the end of the anchor 12 pointing into the oncoming flow of gas, water, etc. In the illustrated embodiment, the leading fairing 130 is formed as a part of a coupler 44, 48. In such an arrangement, the leading fairing 130 may be threadingly secured to the mandrel 40.

The leading fairing 130 may be arranged to provide a substantially gradual transition from approximately the diameter 60 of the housing 42 at a comparatively downstream position 132 to approximately the diameter 134 of the mandrel 40 at a comparatively upstream position 136. In selected embodiments, connections 32 may prevent a leading fairing 130 from providing a substantially gradual transition from exactly the diameter 60 of the housing 42 to exactly the diameter 134 of the mandrel 40.

For example, a leading fairing 130 may be formed on a coupler 44, 48 providing a female connection 32 to the mandrel 40 and a female connection 32 to an adjoining section 16 of tubing 14. In such arrangement, a leading fairing 130 may provide a substantially gradual transition from the diameter 60 of the housing 42 to the outer diameter 138 of a coupler 44, 48, sized to engage tubing 14 having an outer diameter 140 similar to that of the mandrel 40. A leading fairing 130 so arranged may be considered to provide a substantially gradual transition from the diameter 60 of the housing 42 to the to approximately the diameter 134 of the mandrel 40.

In selected embodiments, a substantially gradual transition between various diameters 60, 134, 138, 140 may be accomplished by using a fairing 56, 58 shaped to redirect the flow 142 (e.g. gas, water, debris, or some combination thereof) to pass smoothly by an anchor 12. In certain embodiments, a fairing 56, 58 may have a profile 144 defining the substantially gradual transition. While selected profiles 144 may provide a superior transition, many profiles 144 may provide a substantially gradual transition. For example, the linear profile illustrated has been found effective.

Referring to FIGS. 10-14, in certain embodiments, a substantially gradual transition may be defined by a profile 144*a* having a straight diagonal 146. In other embodiments, a substantially gradual transition may be defined by a profile 144*b* having a diagonal 146 with rounded connections 148 to neighboring segments 150. In still other embodiments, a substantially gradual transition may be defined by a profile 144*c* having a steep diagonal 146 with rounded connections 148 to neighboring segments 150.

In still other embodiments, a substantially gradual transition may be defined by a profile 144*d* having more than one straight diagonal 146*a*, 146*b*. In still other embodiments, a substantially gradual transition may be defined by a profile 144*e* having more than one slope or diagonal 146*a*, 146*b* with rounded connections 148 to neighboring segments 150. In general, a substantially gradual transition may be any profile 144 whose array of normal vectors 152 includes none that point directly into oncoming flow 142.

Figure 15:
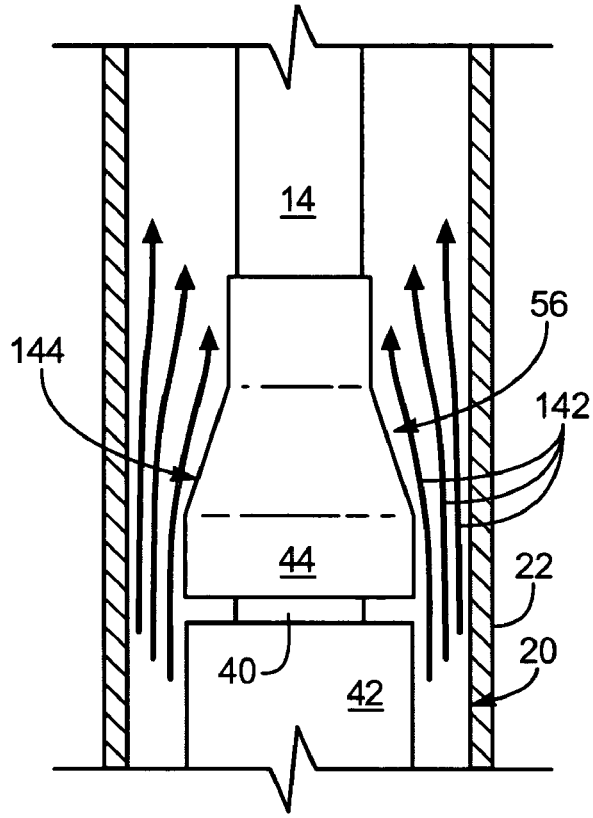
FIG. 15 is a side, elevation, partial cross-sectional view of a well bore and anchor without a trailing fairing.
Figure 16:
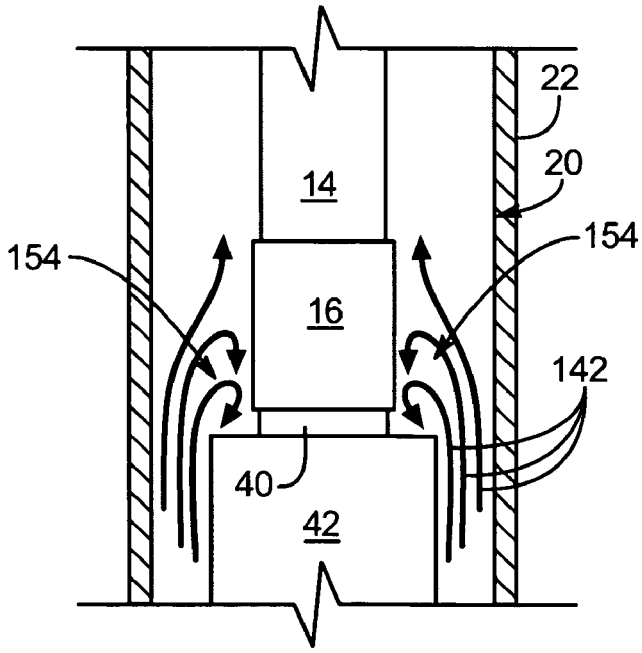
FIG. 16 is a side, elevation, partial cross-sectional view of a well bore and anchor having a trailing fairing in accordance with the present invention.

Referring to FIGS. 15 and 16, bluff bodies, such as anchors 12 without trailing fairings, generate trailing recirculation zones 154 or eddies 154, which greatly increase the drag on the flow 142 passing by the anchor 12. By applying a trailing fairing 156, an anchor 12 may be converted into a more streamlined body with limited or weak, drag-inducing, recirculation zones 154.

A trailing fairing 156 may be defined as a fairing 56, 58 located near or at the downstream end of the anchor 12 reducing in cross section along the direction of the flow 142 of the fluid, gas, water, etc. In the illustrated embodiment, the trailing fairing 156 is formed as a part of a coupler 44, 48. In such an arrangement, the trailing fairing 156 may be threadingly secured to the mandrel 40.

In general, a trailing fairing 156 may be arranged to provide a substantially gradual transition from approximately the diameter 60 of the housing 42 at a comparatively upstream location 136 to approximately the diameter 134 of the mandrel 40 at a comparatively downstream location 132. Similar to a leading fairing 130, in selected embodiments, connections 32 may prevent a trailing fairing 156 from providing a substantially gradual transition from exactly the diameter 60 of the housing 42 to exactly the diameter 134 of the mandrel 40. However, a trailing fairing 156 may accommodate the wall thicknesses of various coupling schemes and still be approximately the diameter of the mandrel 40.

Various profiles 144, such as those illustrated in FIGS. 10-14, may be applied to a trailing fairing 156 in accordance with the present invention. Several factors may be considered when selecting a profile 144 for a trailing fairing 156. For example, space for locating the fairing 156, material costs, manufacturing costs, anticipated velocity of the flow 142 within the well bore 20, and the like may be considered. A particular profile 144 may work (i.e. reduce drag) better in flows 142 below a selected velocity than those above that velocity. However, trailing fairings 156 in accordance with the present invention may provide significant reductions in drag without necessarily coming close to optimal drag-reducing performance.

Figure 17:
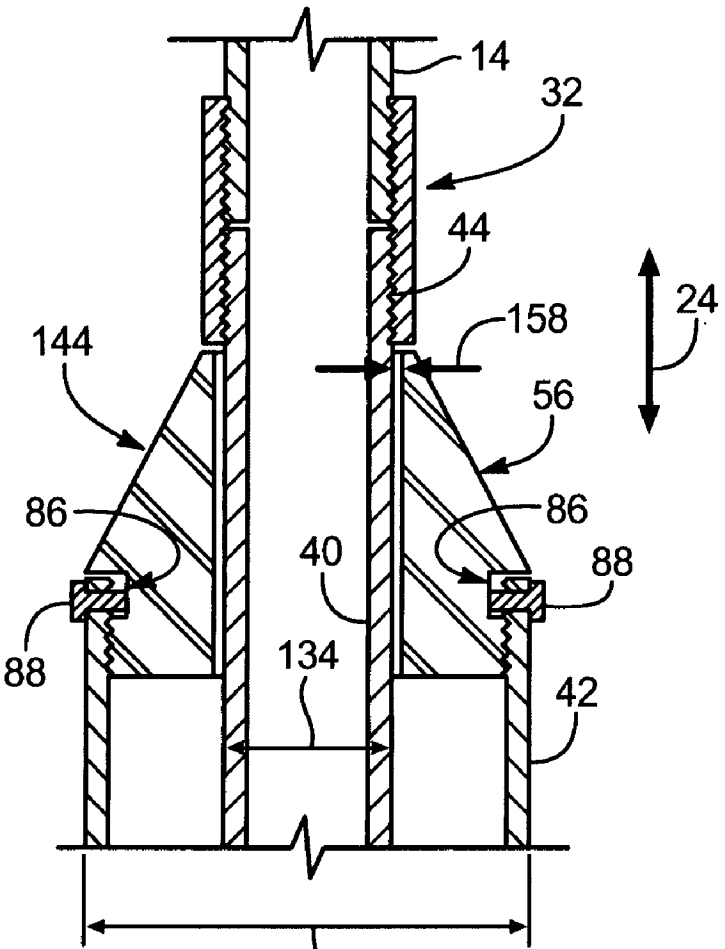
FIG. 17 is partial, side elevation, cross-sectional view of an anchor having an end cap formed as a fairing in accordance with the present invention.

Referring to FIG. 17, in selected embodiments, a fairing 56, 58 may secure to the housing 42. The fairing 56, 58 may extend from the housing 42 toward the mandrel 40 to provide a substantially gradual transition between the respective diameters 60, 134. A clearance 158 may be formed between the fairing 56, 58 and the mandrel 40 to permit the mandrel 40 to rotate independently with respect to the housing 42. In selected embodiments, an end cap 84 may include an extension 90 having a profile 144 shaped to provide such a fairing 56, 58. If desired, the end cap 84 may threadingly engage an end of the housing 42. The end cap 84 may have a channel 86 permitting set screws 88 to securely lock the end cap 84 to the housing 42. An end cap 84 shaped as a fairing 56,58 may be applied to one or both ends of the housing 42.

Fairings 56, 58 in accordance with the present invention, both leading 130 and trailing 156 (see FIGS. 21-24), may be formed of any suitable material. In selected embodiments, the loads imposed on fairings 56, 58 may be far less than those imposed on the various other components of an anchor 12. Accordingly, a wide variety of materials may be used. Suitable materials for forming fairings 56, 58 may include metals, metal alloys, polymers, reinforced polymers, composites, and the like.

Figure 18:
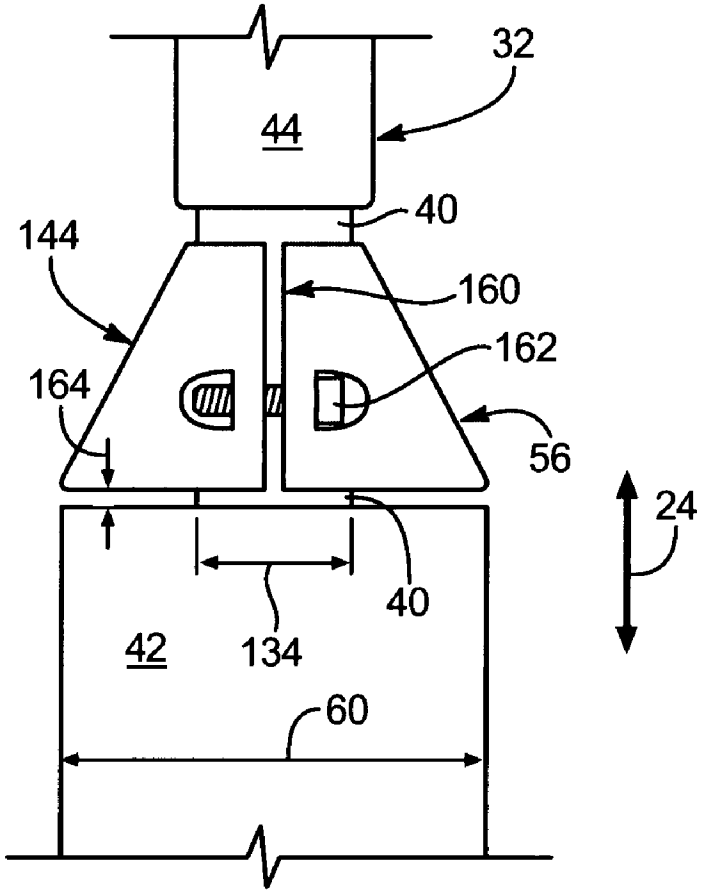
FIG. 18 is a partial, side elevation view of an anchor having a clamp-on fairing in accordance with the present invention.
Figure 19:
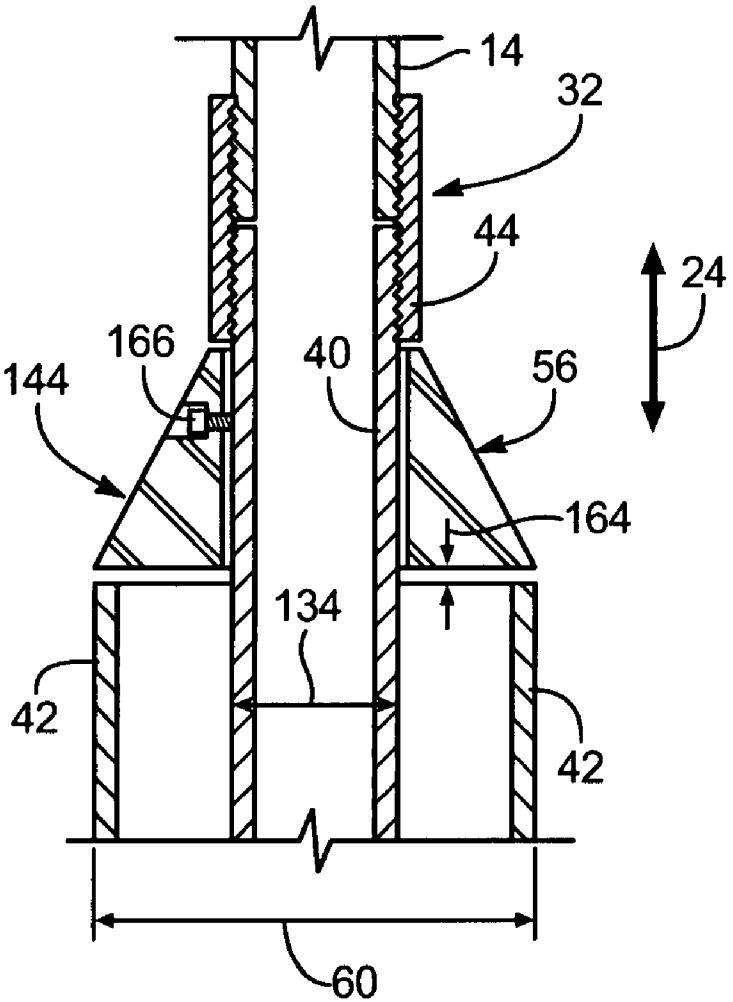
FIG. 19 is a partial, side elevation, cross-sectional view of an anchor having a set-screw fairing in accordance with the present invention.

Referring to FIGS. 18 and 19, in selected embodiments, a fairing 56, 58 may secure directly to a mandrel 40. For example, in the illustrated embodiment of FIG. 18, a fairing 56, 58 may be formed as a circumferentially adjustable clamp. A slit 160 may be formed in the fairing 56, 58. A fastener 162 (e.g. bolt) may engage the fairing 56, 58 on both sides of the slit 160. By adjusting the fastener 162, the circumference of the fairing 56, 58 as it surrounds the mandrel 40 may be adjusted. By sufficiently tightening the fastener 162, the fairing 56, 58 may be effectively locked in place on the mandrel 40. In an alternative embodiment illustrated in FIG. 19, a fairing 56, 58 may secure directly to a mandrel 40 using one or more set screws 166. If desired, a clearance 164 may be formed between the fairing 56, 58 and the housing 42 to permit the housing 42 to rotate independently with respect to the mandrel 40.

Figure 20:
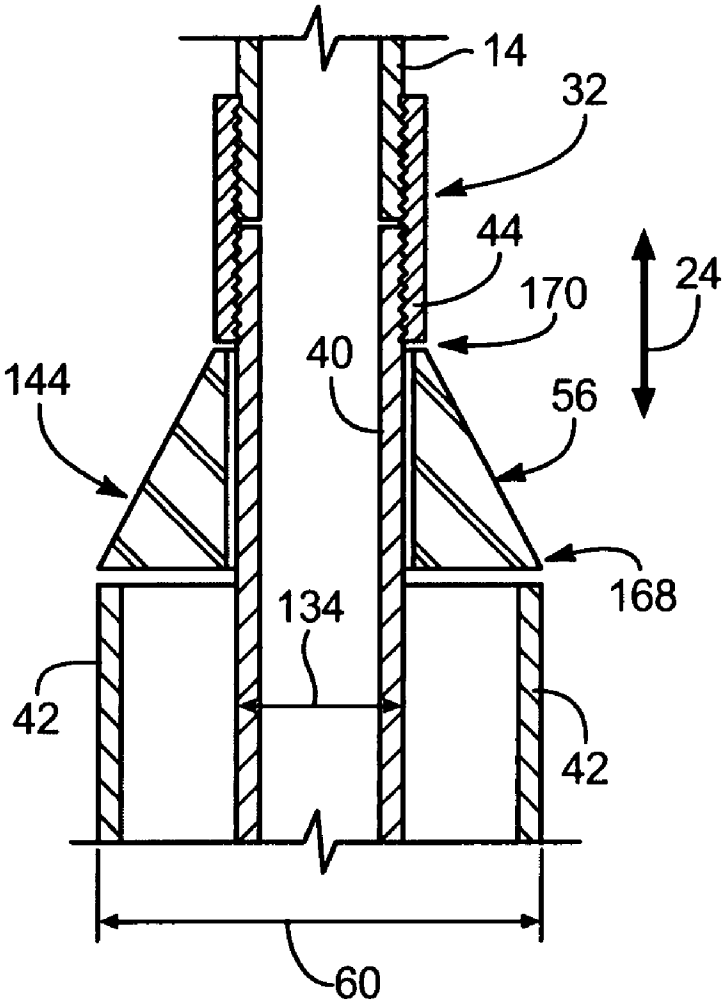
FIG. 20 is a partial, side elevation, cross-sectional view of an anchor having a floating fairing in accordance with the present invention.

Referring to FIG. 20, in selected embodiments, a fairing 56, 58 may secure to neither a coupler 44,48, mandrel 40, nor housing 42. For example, in selected embodiments, a fairing 56, 58 may "float" on a mandrel 40. In such embodiments, the fairing 56, 58 may rotate independently from both the mandrel 40 and the housing 42. The movement of the fairing 56, 58 may be limited in the axial direction by the housing 42 on one end 168 and a coupler 44, 48 on the other end 170.

Figure 21:
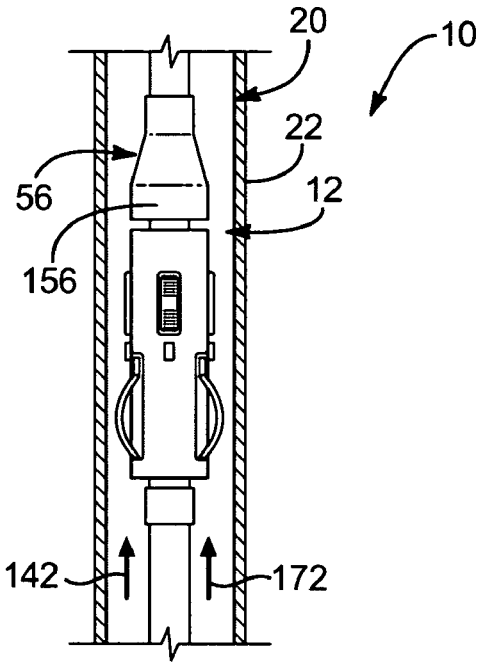
FIG. 21 is a side, elevation, partial cross-sectional view of a well bore and an anchor with no leading fairing and a trailing fairing secured to the top of the anchor in accordance with the present invention.
Figure 22:
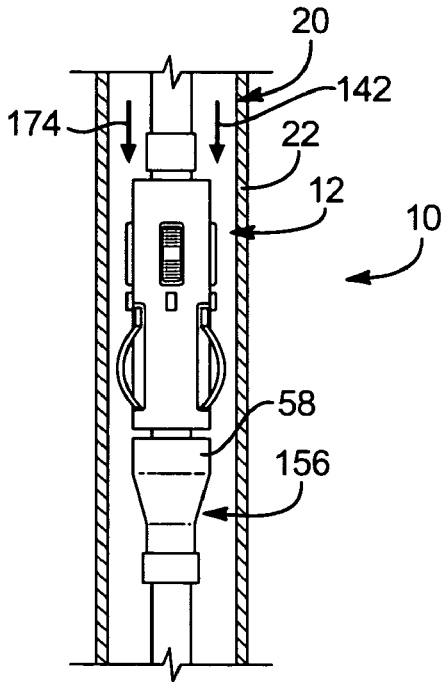
FIG. 22 is a side, elevation, partial cross-sectional view of a well bore and an anchor with no leading fairing and a trailing fairing secured to the bottom of the anchor in accordance with the present invention.

Referring to FIGS. 21 and 22, depending on various factors, including the depth of an anchor 12 within a well bore 20, materials such as gas, water, debris and the like may travel up 172 or down 174 past an anchor 12. For example, in selected embodiments, an anchor 12 may be positioned above a perforation in the well casing 22. Accordingly, significant quantities of gas may be moving up 172 past the anchor 12. In such an embodiment, a trailing fairing 156 may be positioned on the upward or upper end of the anchor 12.

In other embodiments, an anchor 12 may be positioned below a perforation in the well casing 22. Accordingly, significant quantities of water may be moving down 174 past the anchor 12 on the way to a pump inlet. In such an embodiment, a trailing fairing 156 may be positioned on the downward or other end of the anchor 12.

Figure 23:
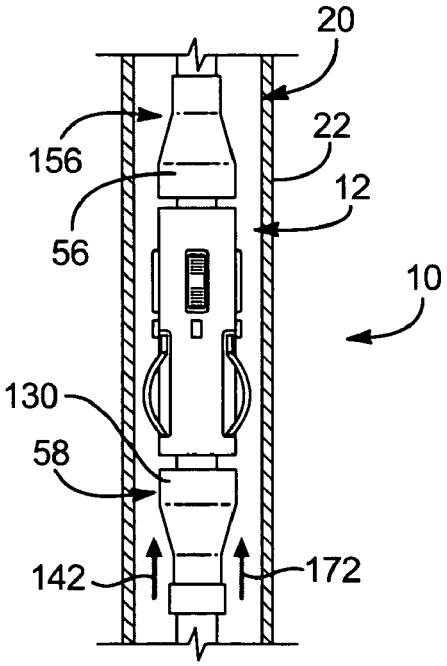
FIG. 23 is a side, elevation, partial cross-sectional view of a well bore and an anchor with a bottom, leading fairing and a top, trailing fairing in accordance with the present invention.
Figure 24:
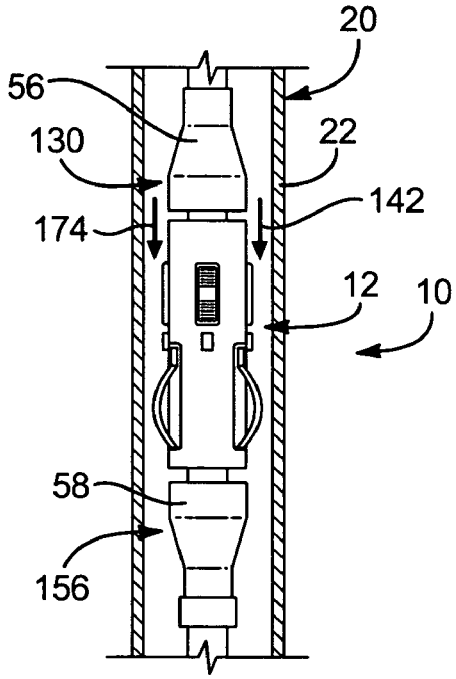
FIG. 24 is a side, elevation, partial cross-sectional view of a well bore and an anchor with a top, leading fairing and a bottom, trailing fairing in accordance with the present invention.

Referring to FIGS. 23 and 24, in certain embodiments, materials such as gas, water, debris etc. may travel up 172 and down 174 past an anchor 12. Changes in the direction of the flow 142 may be sporadic and unpredictable as gas, water, etc. froth within a well bore 20. In such embodiments, fairings 56, 58 may be placed on both ends of the anchor 12. Accordingly, when the flow 142 is generally traveling up 172, a lower fairing 58 may act as a leading fairing 130 while a higher fairing 56 acts as a trailing fairing 156. Alternatively, when the flow 142 is generally traveling down 174, a higher or upper fairing 56 may act as a leading fairing 130 while a lower fairing 58 acts as a trailing fairing 156.

Figure 25:
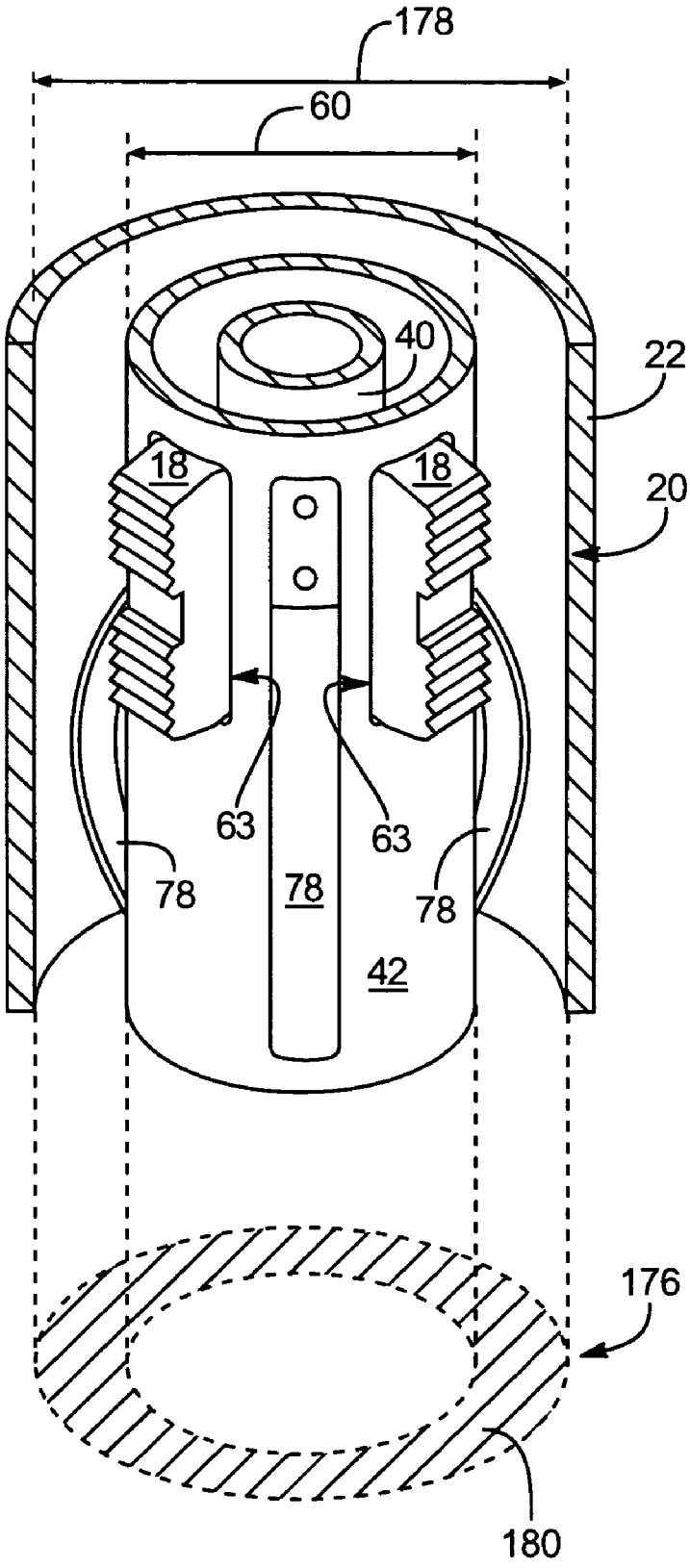
FIG. 25 is a perspective, partial cross-sectional view of a well bore and anchor illustrating the annulus therebetween in accordance with the present invention.

Referring to FIGS. 25-27, an annulus 176 for flow may be defined as a ring-like region extending in the space between an outer diameter 60 of a housing 42 and an inner diameter 178 of a well bore 20. Often, a well bore 20 is cased so that the inner diameter 178 of the well bore 20 is effectively the inner diameter 178 of the well casing 22. In general, a central tube and the outer diameter of the well's channel of flow (inside surface of the well) will form an annulus.

In various types of wells 10, fluids are passed within the annulus 176. For example, in coal bed methane wells 10, the desired gas may flow up 38, 172 a well bore 20 to reach the surface 30. Accordingly, in selected embodiments, gas in a coal bed methane well 10 may pass through the annulus 176 defined or bounded by an anchor 12 and the well bore 20.

Anchors 12 in accordance with the present invention may be sized, constructed, and arranged to accomplish the anchoring function without creating an overly restrictive annulus 176 that limits the gas production of the well 10. For example, in selected embodiments, an anchor 12 may be created with a housing 42 having a comparatively smaller outer diameter 60 to increase the cross-sectional area 180 of the annulus 176. In certain embodiments, slips 18 with a greater radial height 124 may be used to accomplish the greater throw (extension) necessary to bridge the larger gap between a smaller housing 42 and the well bore 20. If desired, slips 18 with increased height 124 may be chamfered or otherwise shaped to facilitate their insertion within the housing 42 during assembly.

An overly restrictive annulus 176 may limit gas production even in arrangements where significant quantities of gas are not required to pass by an anchor 12 before reaching the surface 30. For example, in selected embodiments, water exiting a coal seam aquifer may be required to pass through the annulus 176 before reaching a pump inlet. If the annulus 176 is more restrictive, water extraction from the well 10 will be slowed to that extent. A reduction in the rate of water extraction will, in turn, typically cause a reduction in the rate of gas production.

Small reductions in the outer diameter 60 of a housing 42 can result in large increases in the cross-sectional area 180 of the annulus. For example, in seven-inch, twenty-three pound, well casing 22, an anchor 12 that performs the anchoring function with a housing 42 approximately eighteen percent smaller in diameter 60 (e.g. a reduction from an outer diameter of five and a half inches to an outer diameter of four and a half inches) produces an increase of approximately ninety-seven percent in the cross-sectional area 180 of the annulus 176. Similarly, in five and a half inch, seventeen-pound well casing 22, an anchor 12 that performs the anchoring function with a housing 42 approximately seventeen percent smaller in diameter 60 (e.g. a reduction from an outer diameter of four and a half inches to an outer diameter of three and three quarters inches) produces an increase of approximately one hundred and sixty-nine percent in the cross-sectional area 180 of the annulus 176. Drag is a direct function of cross-sectional area.

Increasing the cross-sectional area 180 of an annulus 176 may provide several advantages. As mentioned, when applied to coal bed methane wells 10, increases in cross-sectional area 180 of an annulus 176 may result in substantially improved gas production. However, increases in cross-sectional area 180 of an annulus 176 may also result in reduced deposition of debris (e.g. sand, sediment) within an anchor 12. Increases in flow past an anchor 12 may create a washing effect that may tend to rinse away debris that may otherwise collect and cause an anchor 12 to lock-up or otherwise malfunction. Moreover, increases in cross-sectional area 180 of an annulus 176 and the resulting increases in flow appear to limit corrosion of the anchor 12.

Figure 28:
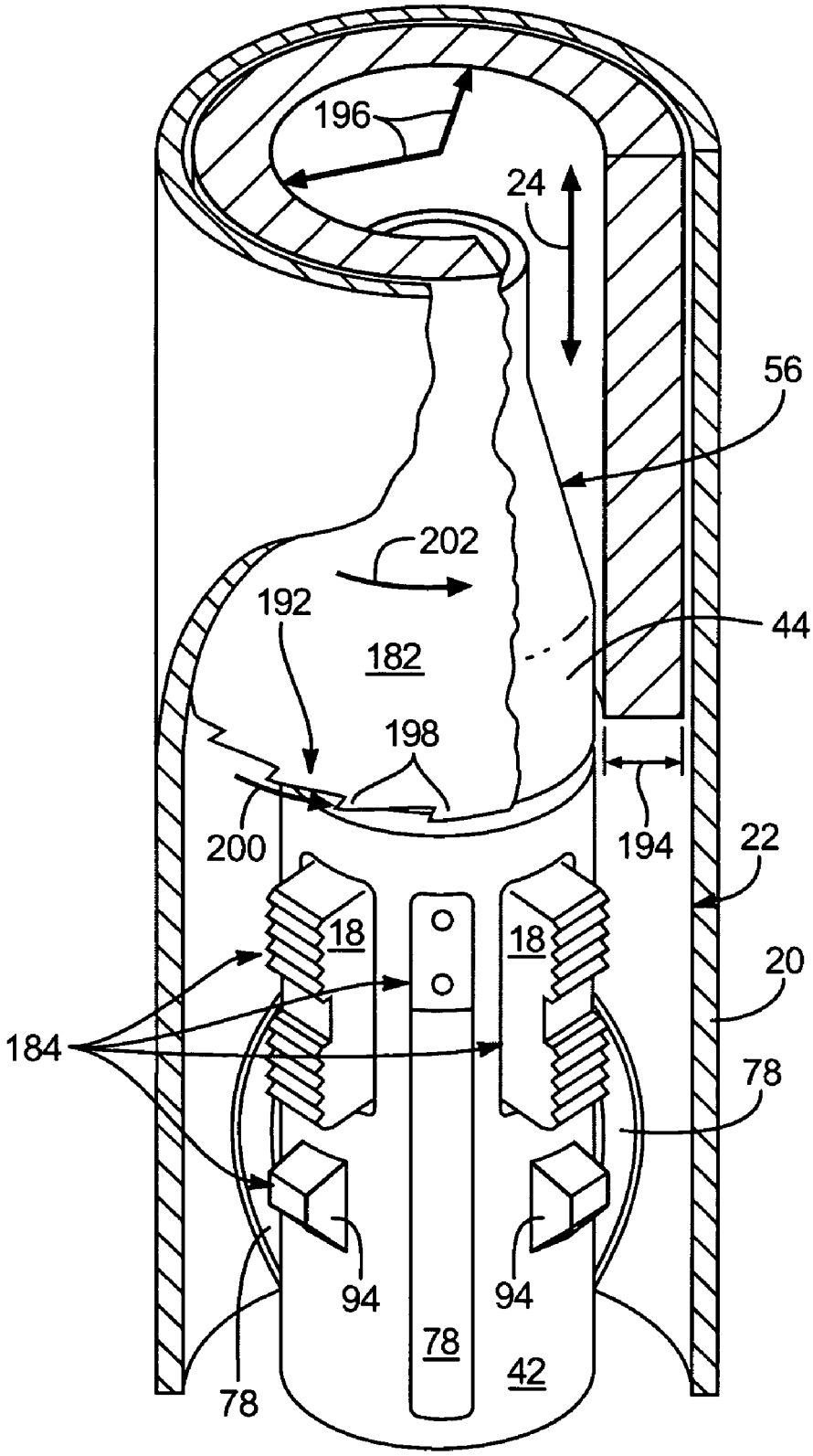
FIG. 28 is a perspective, partial cross-sectional view of a well bore and anchor illustrating a cutting tool operating in the annulus between the inner diameter of the well bore and the outer diameter of the anchor housing in accordance with the present invention therebetween.
Figure 29:
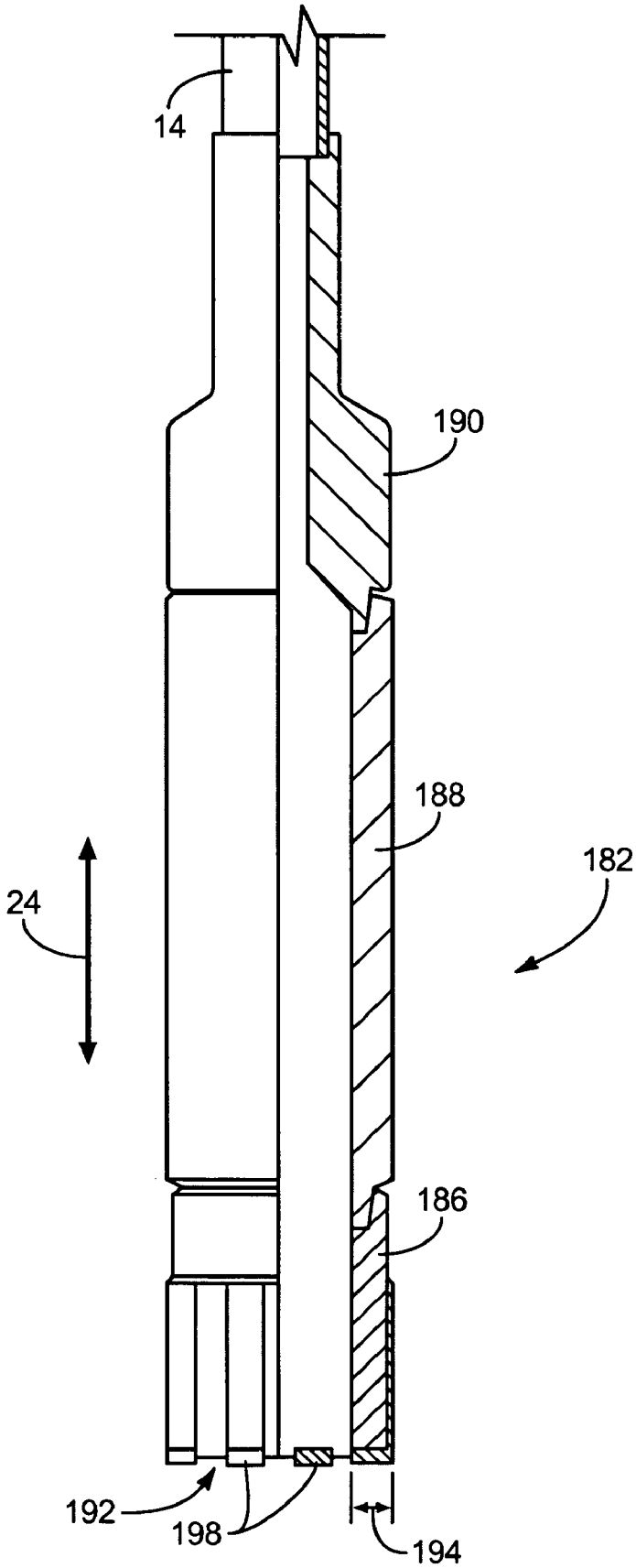
FIG. 29 is a side, elevation, partial cross-sectional view of a coring drill bit comprising a driving bushing, washpipe, and rotary milling shoe in accordance with the present invention.

Referring to FIGS. 28 and 29, in certain situations, an anchor 12 may be jammed, seized, or otherwise inoperatively locked in a well bore 20. In such situations, it may be desirable or necessary to remove the anchor 12 by cutting it free. A tool 182 sized to cut substantially exclusively within the annulus 176 may be positioning therewithin. The tool 182 may be rotated and advanced over the housing 42 to remove or cut through any extension members 184 (e.g. slips 18, drag springs 78, slip protectors 94, etc.) situated within the annulus 176.

In general, the extension members 184 may be the only components securing an anchor 12 to the well bore 20. Accordingly, once the extension members 184 are removed or cut, the anchor 12 may be freed. By selecting a tool 182 that cuts substantially exclusively within the annulus 176, the housing 42, mandrel 40, cones 64, 66, etc. may be left intact. As a result, if desired, the majority of the anchor 12 may be reused. Moreover, by operating substantially exclusively within the annulus 176, the tool 182 does not cut through the housing 12. By limiting the total extent of material that must be drilled out, removed, or cut, significant time savings (often an order of magnitude or more) may be achieved. In some situations, this time saved may be one or more days. Cutting an anchor free may take less than an hour, and has taken less than a half hour of cutting in actual practice.

In selected embodiments, a tool 182 may be a coring drill bit. For example, in one embodiment, a tool 182 may comprise a rotary milling shoe 186 mounted on a washpipe 188. A tool 182 may be positioned and rotated by any suitable method. In certain embodiments, the tubing 14 (e.g. the tubing extending between the anchor 12 and the surface 30) may be separated from the anchor 12. A tool 182 may be secured to the tubing 14 (e.g. by a drive bushing 190) and lowered, at a lower end thereof, back down to the anchor 12. The tubing 14 may then be rotated and advanced to correspondingly rotate and advance the tool 182.

A tool 182 in accordance with the present invention may have a cutting edge 192 having a width 194 sized in a radial direction 196 to remain operable until the anchor 12 is free. In selected embodiments, a tool 182 may have teeth 198 sized to support shear loading and remain operable in response to forces 200 on the cutting edge 192 in a circumferential direction 202 during cutting of the extension members 184. A tool 182 may also have a cross section and material selected to operably support compressive stresses in an axial direction 24 imposed in response to cutting of the extension members 184. Additionally, a tool 182 may have a mass and thermal conductivity selected to operably support dissipation of heat generated by cutting of the extension members 184.

As the cross-sectional area 180 of an annulus 176 decreases, the shear loading, compressive loading, and heat loading of a tool 182 operating substantially exclusively within the annulus 176, may become excessive. For example, if the width 194 of the cutting edge 192, cross-section, or heat capacity is insufficient, the tool 182 may break, dull, deform, overheat, or the like before the tool 182 is able cut sufficiently deep to free the anchor 12. Accordingly, there is a limit to how small the cross-sectional area 180 of an annulus 176 may be and still be practical to have a tool 182 free an anchor 12 therein, while operating substantially exclusively within the annulus 176.

In situations where the annulus 176 is too small to accept a tool 182 having the dimensions (e.g. width 194, cross-section, etc) needed to complete the cutting necessary to free the anchor 12, a bigger tool 182 may be provided. A bigger tool 182 may, however, be unable to operate substantially exclusively within the annulus 176. Accordingly, the bigger tool 182 may engage in the time consuming process of cutting through the housing 42, cones 64, 66 etc., or a portion thereof.

The present invention may be embodied in other specific forms without departing from its basic features or essential characteristics. The described embodiments are to be considered in all respects only as illustrative, and not restrictive. The scope of the invention is, therefore, indicated by the appended claims, rather than by the foregoing description. All changes which come within the meaning and range of equivalency of the claims are to be embraced within their scope.

What is claimed and desired to be secured by United States Letters Patent is:

1. A method of removably anchoring well tubing in a well bore, the method comprising:

selecting a well having a bore diameter and an anchor positioned therein, the anchor having an exterior, a housing constituting a portion of the exterior end defining an anchor diameter at the portion and extension members extending from the housing toward the bore diameter, the bore diameter and anchor diameter spaced apart a distance defining an annulus therebetween and extending along the well;

selecting a tool sized to cut substantially exclusively within the annulus;

positioning the tool within the annulus; and driving the tool past the housing to remove the extension members between the housing and the bore diameter to free the anchor.

2. The method of claim 1, wherein selecting a tool further comprises selecting a bit having a cutting edge having a width sized in a radial direction to remain operable until the anchor is free.

3. The method of claim 2, wherein selecting a tool further comprises selecting a bit having teeth sized to support shear loading and remain operable in response to forces on the cutting edge in a circumferential direction during cutting of the extension members.

4. The method of claim 3, wherein selecting a bit further comprises selecting a cross section and material thereof to operably support compressive stresses in an axial direction imposed in response to cutting of the extension members.

5. The method of claim 4, wherein selecting a tool further comprises selecting a mass and thermal conductivity thereof to operably support dissipation of heat generated by cutting of the extension members.

6. The method of claim 5, wherein selecting a well comprises selecting a coal bed methane well.

7. The method of claim 6, wherein the extension members comprise at least one slip and at least one drag spring.

8. The method of claim 7, wherein driving the tool further comprises mounting the tool on a tube withdrawn from the anchor, rotating the tool, and advancing the tool.

9. The method of claim 8, wherein selecting a tool comprises selecting a bit connected to a washpipe.

10. The method of claim 9, wherein selecting a well comprises selecting a well having a casing of from about fifteen to about twenty pound, nominal five and a half inch well casing.

11. The method of claim 10, wherein selecting a well further comprises selecting a well containing a well anchor having an anchor diameter of approximately three and three quarters inches.

12. The method of claim 9, wherein selecting a well comprises selecting a well lined with a casing of from about twenty-three to about twenty-nine pound. nominal seven inch casing.

13. The method of claim 12, wherein selecting a well further comprises selecting a well containing a well anchor having an anchor diameter of approximately four and a half inches.

14. The method of claim 1, wherein selecting a well comprises selecting a coal bed methane well.

15. The method of claim 1, wherein the extension members comprise at least one slip and at least one drag spring.

16. The method of claim 1, wherein driving the tool further comprises mounting the tool on a tube withdrawn from the anchor, rotating the tool, and advancing the tool.

17. The method of claim 1, wherein selecting a tool comprises selecting a washpipe and milling shoe.

18. The method of claim 1, wherein selecting a well comprises selecting a well having a casing of from about fifteen to about twenty pound, nominal five and a half inch well casing and an anchor having an anchor diameter of approximately three and three-quarters inches.

19. The method of claim 1, wherein selecting a well comprises selecting a well lined with a casing of from about twenty-three to about twenty-nine pound, nominal seven inch casing and an anchor having an anchor diameter of approximately four and a half inches.

20. A method of removably anchoring well tubing in a well bore, the method comprising:

selecting a well having a bore diameter and an anchor positioned therein, the anchor having an exterior and comprising a mandrel, at least one slip, and a housing constituting the majority, by area, of the exterior and defining an anchor diameter, the bore diameter and anchor diameter spaced apart a distance defining an annulus therebetween and extending along the well;

selecting a tool sized to cut substantially exclusively within the annulus;

positioning the tool within the annulus; and driving the tool past the housing to remove a portion of the at least one slip extending into the annulus to free the anchor.

21. A method comprising:

selecting a coal bed methane well having a bore diameter and an anchor inoperatively lodged therein, the anchor having an exterior and comprising a mandrel surrounded by three slips, at least three drag springs, and a housing constituting the majority, by are, of the exterior and defining an anchor diameter, the bore diameter and anchor diameter spaced apart a distance defining an annulus therebetween and extending along the well;

selecting a coring drill bit sized to fit substantially exclusively within the annulus;

positioning the coring drill bit within the annulus; and rotating and advancing the coring drill bit to remove the portions of the three slips and at least three drag springs positioned within the annulus to free the anchor.

* * * * *